US007209109B2

(12) United States Patent
Furuichi

(10) Patent No.: US 7,209,109 B2
(45) Date of Patent: Apr. 24, 2007

(54) DISPLAY DRIVER, ELECTRO-OPTIC DEVICE, AND DRIVE METHOD

(75) Inventor: Shuji Furuichi, Hachioji (JP)

(73) Assignee: Seiko Epson Corporation (JP)

( * ) Notice: Subject to any disclaimer, the term of this patent is extended or adjusted under 35 U.S.C. 154(b) by 605 days.

(21) Appl. No.: 10/792,664

(22) Filed: Mar. 3, 2004

(65) Prior Publication Data

US 2004/0227714 A1 Nov. 18, 2004

(30) Foreign Application Priority Data

Mar. 6, 2003 (JP) ..... 2003-060004

(51) Int. Cl.
*G09G 3/36* (2006.01)

(52) U.S. Cl. ..... 345/98; 345/100

(58) Field of Classification Search ..... 345/83–100, 345/204, 503, 545, 473; 463/23
See application file for complete search history.

(56) References Cited

U.S. PATENT DOCUMENTS 6,366,288 B1 * 4/2002 Naruki et al. ..... 345/503
6,459,416 B1 * 10/2002 Sasaki et al. ..... 345/89

FOREIGN PATENT DOCUMENTS

JP 06-004043 1/1994
JP 07-191299 7/1995
JP 9-218385 8/1997
JP 2000258750 * 9/2000
JP 2003-032244 1/2003

OTHER PUBLICATIONS

Patent Abstracts of Japan regarding Publication No. 09-218385, published Aug. 19, 1997.
Communication from Japanese Patent Office regarding counterpart application.

* cited by examiner

*Primary Examiner*—Nitin Patel
(74) *Attorney, Agent, or Firm*—Harness, Dickey & Pierce, P.L.C.

(57) ABSTRACT

A display driver is provided including: a code generator that generates pseudo random number sequences by a linear feedback shift register LFSR; a signal generator that receives the random number sequences output from taps Q3 and Q4 of the LFSR and generates field selection signals F1 and F2 that randomly vary field selection sequences; and a scan driver that outputs scan signals corresponding to the fields selected by the field selection signals F1 and F2 to the scan lines, and selectively drives the scan lines by a multi-line drive method. A field counter FDCT, whose load value is set by K bits of data with each bit configured based on random number sequences from K taps, increments or decrements its count value.

11 Claims, 16 Drawing Sheets

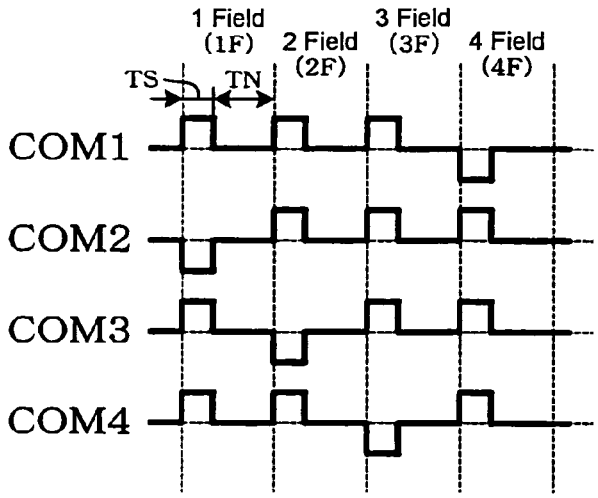

FIG.4A

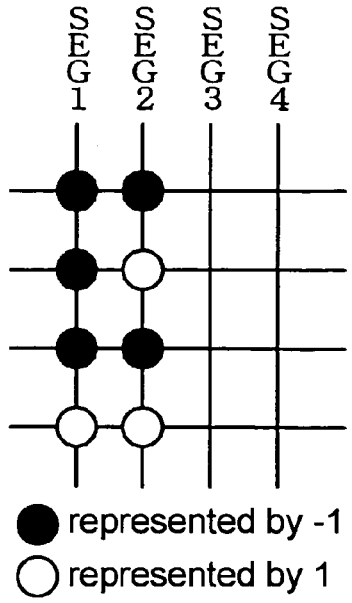

FIG.4B

MLS computation

A1 A3 A5

$$\cdot\text{SEG1}\quad \begin{pmatrix} 1 & 1 & 1 & -1 \\ -1 & 1 & 1 & 1 \\ 1 & -1 & 1 & 1 \\ 1 & 1 & -1 & 1 \end{pmatrix} \begin{bmatrix} -1 & -1 & -1 & 1 \end{bmatrix} = \begin{bmatrix} 0 \\ 0 \\ -4 \\ 0 \end{bmatrix} \begin{matrix} \text{VC} \\ \text{VC} \\ \text{MV2} \\ \text{VC} \end{matrix}$$

$$\begin{matrix} 1\times(-1)+(-1)\times(-1)+1\times(-1)+1\times 1 \\ 1\times(-1)+1\times(-1)+(-1)\times(-1)+1\times 1 \\ 1\times(-1)+1\times(-1)+1\times(-1)+(-1)\times 1 \\ (-1)\times(-1)+1\times(-1)+1\times(-1)+1\times 1 \end{matrix}$$

A2 A4 A6

$$\cdot\text{SEG2}\quad \begin{pmatrix} 1 & 1 & 1 & -1 \\ -1 & 1 & 1 & 1 \\ 1 & -1 & 1 & 1 \\ 1 & 1 & -1 & 1 \end{pmatrix} \begin{bmatrix} -1 & 1 & -1 & 1 \end{bmatrix} = \begin{bmatrix} -2 \\ 2 \\ -2 \\ 2 \end{bmatrix} \begin{matrix} \text{MV1} \\ \text{V1} \\ \text{MV1} \\ \text{V1} \end{matrix}$$

$$\begin{matrix} 1\times(-1)+(-1)\times 1+1\times(-1)+1\times 1 \\ 1\times(-1)+1\times 1+(-1)\times(-1)+1\times 1 \\ 1\times(-1)+1\times 1+1\times(-1)+(-1)\times 1 \\ (-1)\times(-1)+1\times 1+1\times(-1)+1\times 1 \end{matrix}$$

FIG.4C

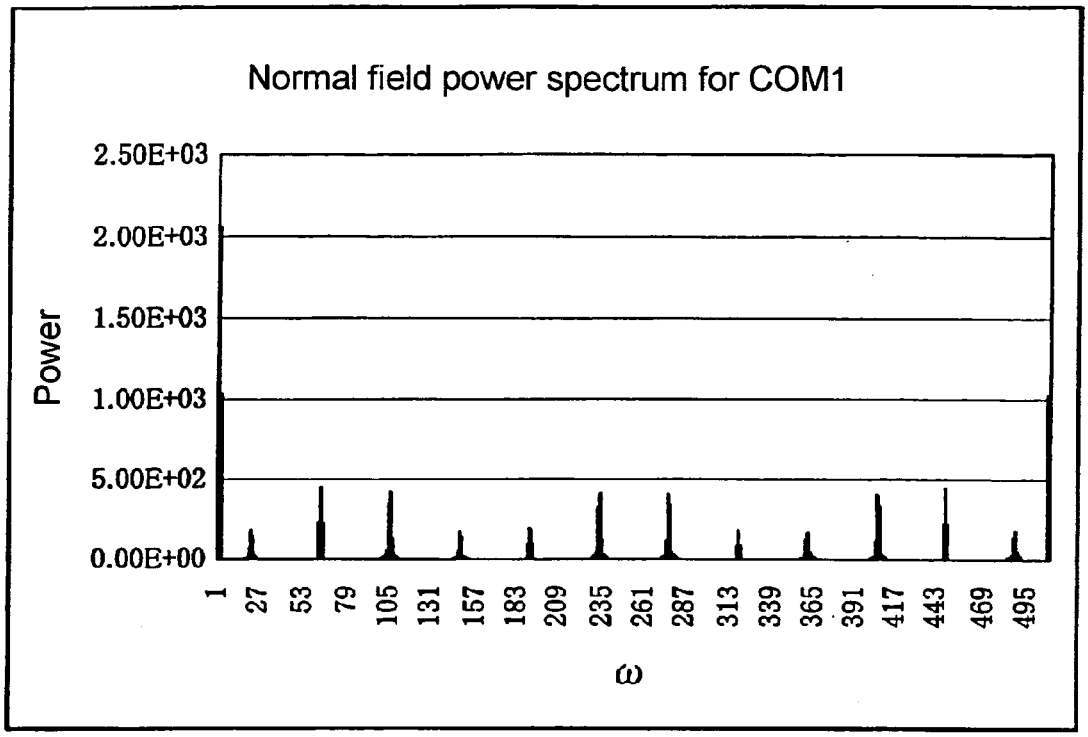
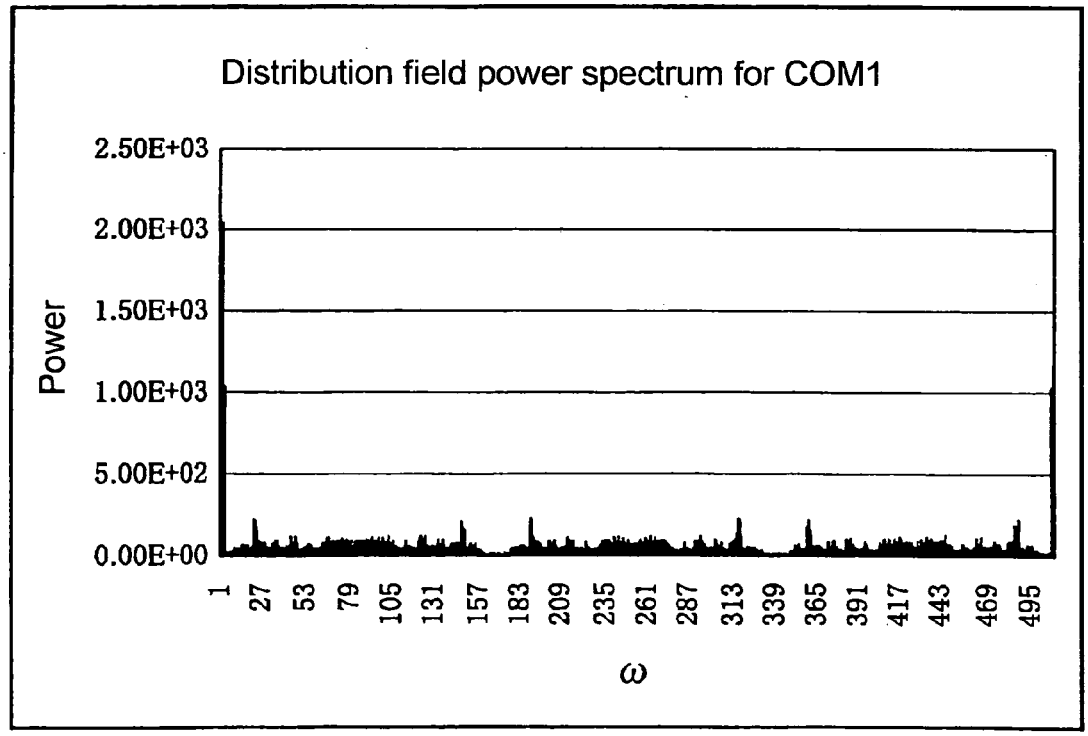
FIG.11

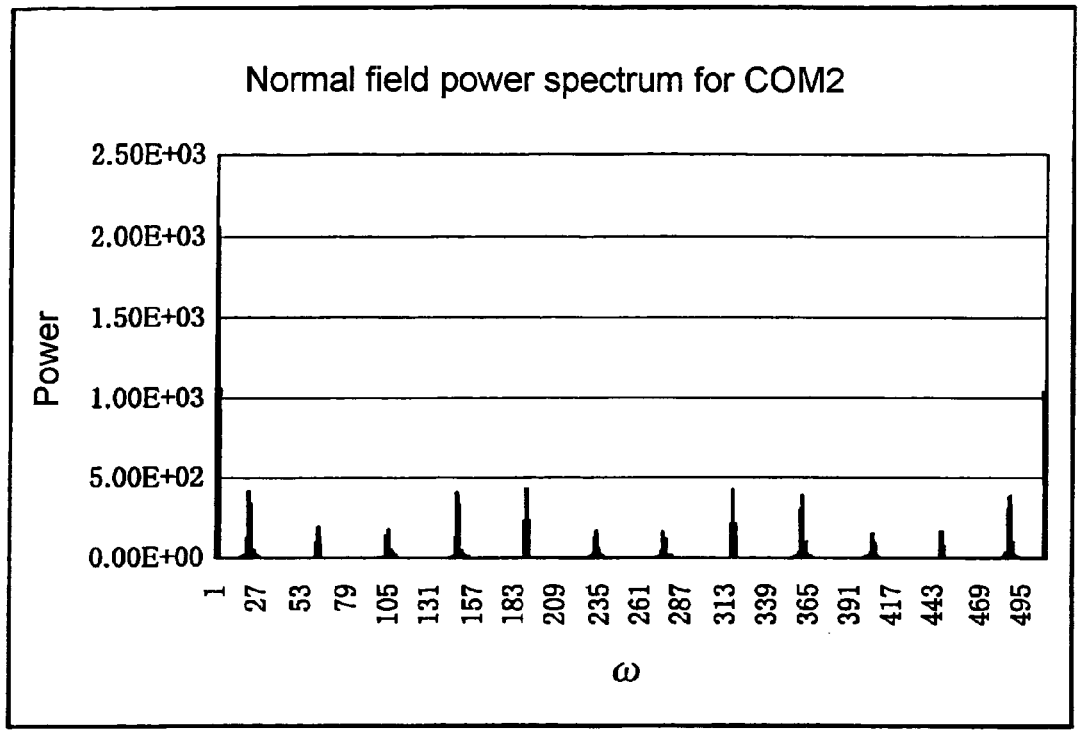
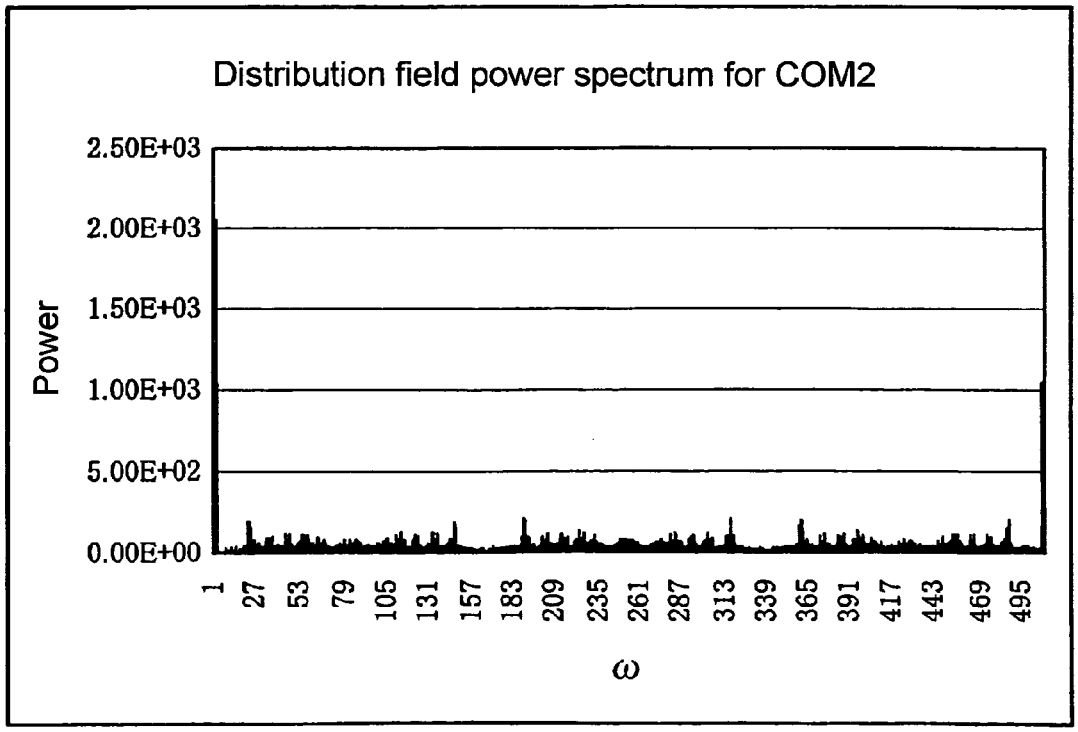
FIG.12

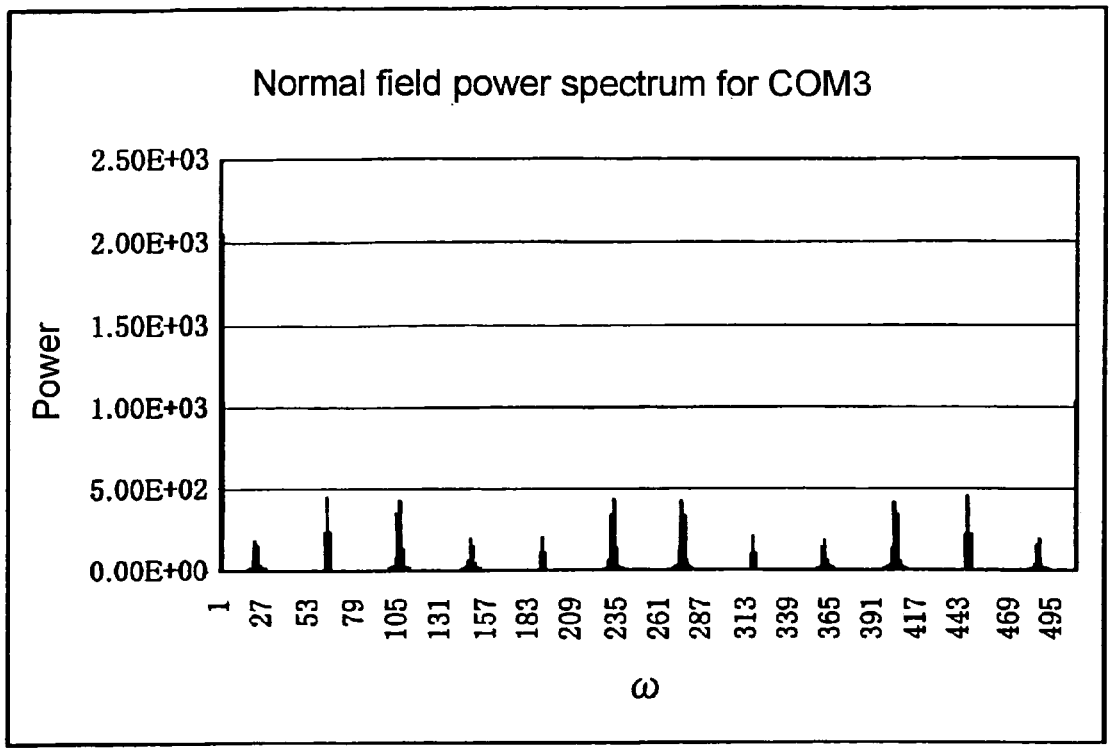
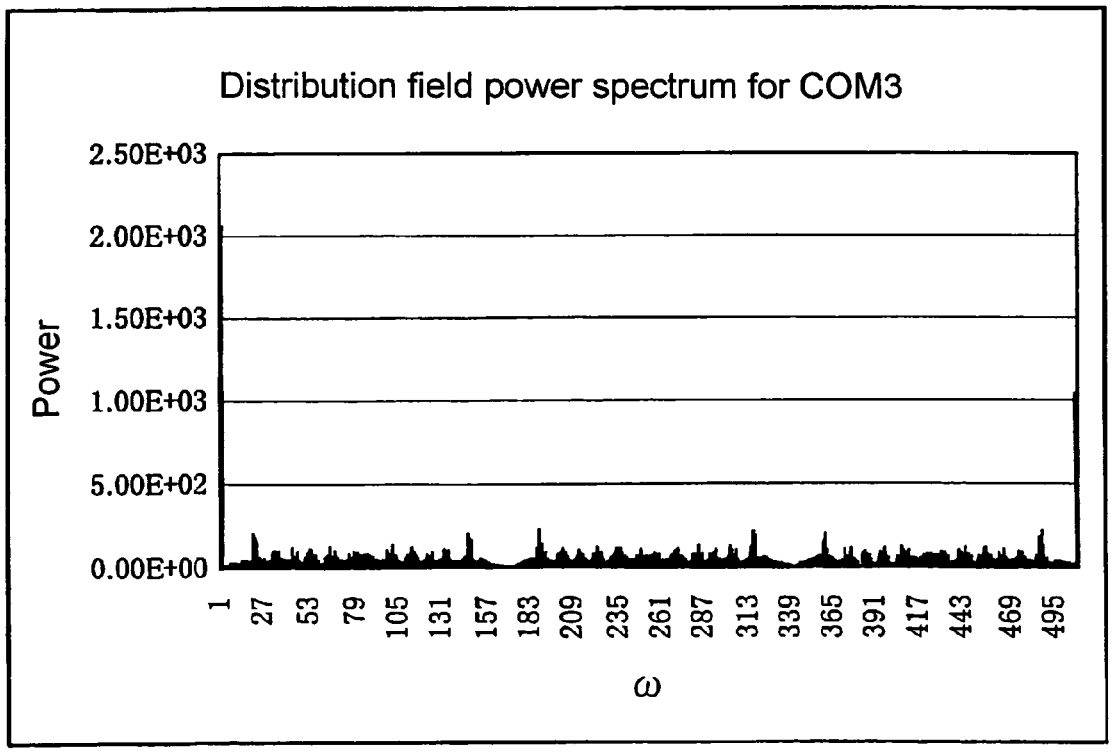
FIG.13

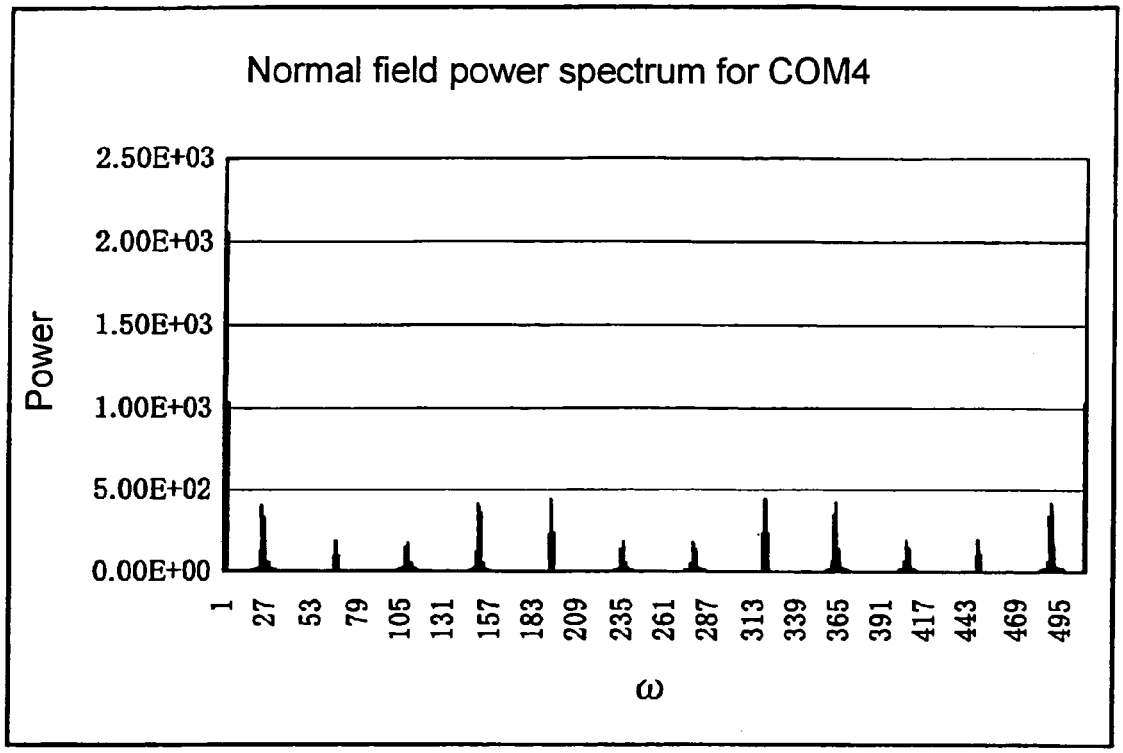
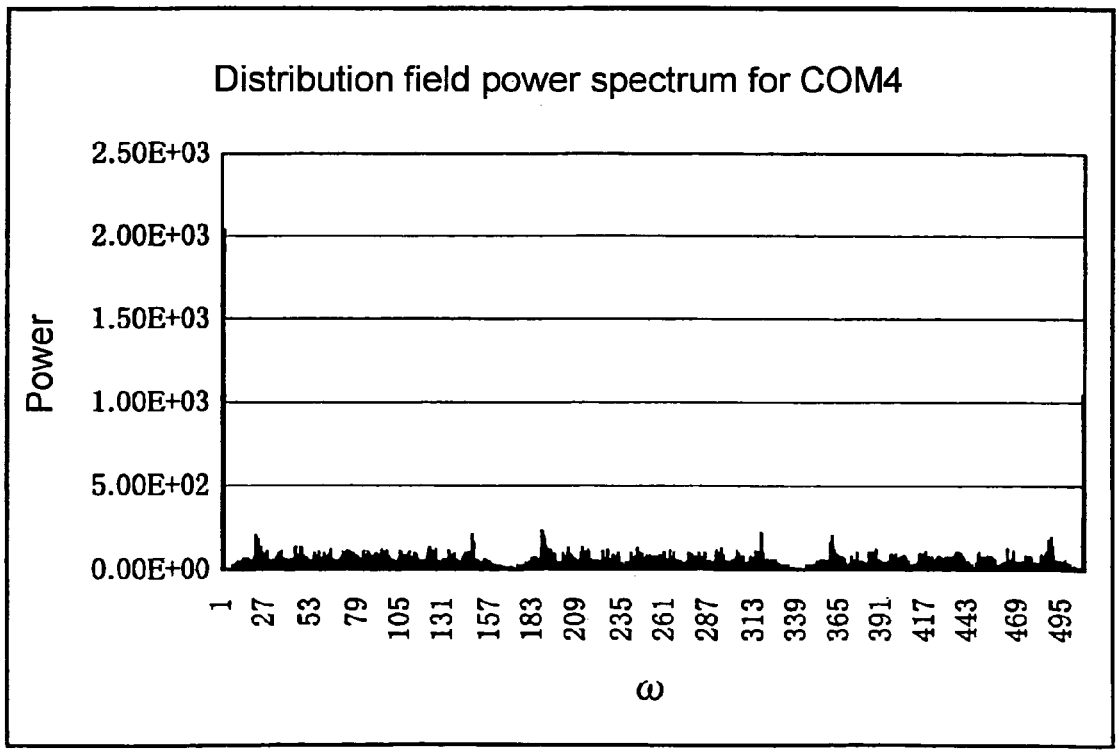
FIG.14

DISPLAY DRIVER, ELECTRO-OPTIC DEVICE, AND DRIVE METHOD

RELATED APPLICATIONS

This application claims priority to Japanese Patent Application No. 2003-060004 filed Mar. 6, 2003 which is hereby expressly incorporated by reference herein in its entirety.

BACKGROUND

1. Field of the Invention

The present invention relates to a display driver, an electro-optic device, and a drive method.

2. Description of the Related Art

For a liquid crystal display device (more broadly, electro-optical device), it is preferable to use liquid crystal materials with a high response speed in order to cope with displays of moving pictures or the like. However, the use of liquid crystals with a high response speed gives rise to the phenomenon termed "frame response", which causes problems such as flickering and decreases in contrast. A publicly-known conventional technique for solving such problems is called the "multi-line selection (MLS) drive method".

As for the display driver of the MLS method, a display panel is driven by simultaneous selection of a plurality of scan lines. The scan lines are grouped into a plurality of groups, and scan signals (selection signals), which cross each other orthogonally within a single frame, are supplied to scan lines in the same group. Furthermore, the selection period is divided into a plurality of sub-selection period (fields), and the voltage is set to the scan signals for each sub-selection period. The data signals to be supplied to the data lines are derived by performing predetermined MLS computations to the display data.

However, it has been found that streak-like display irregularities occur along the scan lines (common) with the MLS method display drivers. Such streak-like display irregularities can be prevented by methods such as re-ordering field selection sequences suitably. However, such a method has problems where it entails increased complexity and size of the circuits composing the display driver, and cannot completely eliminate the streak-like display irregularities. Furthermore, the method for re-ordering field selection sequences and the circuits for realizing such a method must be redesigned for each model of display driver, which prolongs the design period and leads to high development costs.

The present invention has been made in view of the above problems and is intended to provide a display driver, an electro-optic device and a drive method that can prevent the occurrence of streak-like display irregularities or the like.

SUMMARY

The present invention relates to a display driver that drives a display panel by a multi-line drive method, in which a plurality of scan lines are selected simultaneously. The display driver includes at least one code generator, having a linear feedback shift register, and generating pseudo random number sequences with the linear feedback shift register; a signal generator that receives random number sequences output from K taps (K being an integer that is two or more) of the linear feedback shift register included in the at least one code generator, and generates field selection signals that vary field selection sequences randomly based on the random number sequences; and a scan driver that outputs scan signals corresponding to fields selected by the field selection signals to scan lines, and selectively drives the scan lines.

As for the present invention, pseudo random number sequences are generated utilizing the linear feedback shift register, and field selection signals that randomly vary field selection sequences are generated based on the pseudo random number sequences. Then the scan lines are selectively driven while randomly varying field selection sequences based on the field selection signals. In such a way, frequency components that appear in the scan signals can be dispersed, and hence the occurrence of streak-like display irregularities or the like can be prevented. Furthermore, because the pseudo random number sequences are generated utilizing the linear feedback shift register, there is an advantage that streak-like display irregularities can be prevented by just adding a small-sized code generator.

Moreover, as for the present invention, the signal generator may generate field selection signals based on random number sequences output by K taps of a linear feedback shift register of a code generator.

In such a way, K bits of data varying randomly can be generated using a code generator, and the field selection signals can be generated using the K bits of data. Therefore, the display driver can be made even smaller in size.

As for the present invention, the signal generator may also generate field selection signals based on random number sequences output by taps of K registers, which are adjacent each other, and compose the linear feedback shift register.

On the other hand, the signal generator may also generate field selection signals based on random number sequences output by taps of K registers, which are not adjacent each other.

As for the present invention, the signal generator may generate field selection signals based on random number sequences output by K taps of the linear feedback shift registers of a plurality of code generators.

In such a way, for example, the field selection signals can be generated based on the first to $K^{th}$ random number sequences output by the taps of the linear feedback shift registers of first to $K^{th}$ code generators.

Furthermore, as for the present invention, the signal generator may be configured such that the load value is set to the signal generator by K bits of data that each bit is configured based on random number sequences from K taps, and the signal generator includes a field counter, which increments or decrements a count value from the load value, and resets the count value to the opposite upper or lower limit value, when the count value reaches an upper limit value or a lower limit value, and generates field selection signals that correspond to the count value of the field counter.

In such a way, the load value of the field counter is set according to random number sequences from K taps of the linear feedback shift register. The field counter increments or decrements the count value using the load value as the initial value. In such a way, the field selection signals for randomly re-ordering field selection sequences can be generated by a small-sized configuration.

As for the present invention, the code generator may be a generator that generates random number sequences of M-sequences.

In such a way, pseudo random number sequences with longer periods can be generated using the linear feedback shift register with a smaller length, and hence, the code generator can be made even smaller in size. The code generator may be a generator that generates random number sequences of GOLD sequences.

The present invention further relates to an electro-optical device that includes any of the above-described display drivers and a display panel that is driven by such display drivers.

The present invention further relates to a method of driving a display panel by a multi-line drive method that selects a plurality of scan lines simultaneously, including the steps of: generating pseudo random number sequences by the linear feedback shift register of at least one code generator; generating field selection signals that randomly vary field selection sequences based on random number sequences output by K taps (K being an integer that is two or more) of the linear feedback shift register included in the at least one code generator; outputting scan signals corresponding to the fields selected by the field selection signals to the scan lines; and driving the scan lines selectively.

The present invention may be configured such that the field selection signals are generated based on random number sequences output from K taps of the linear feedback shift register of a code generator.

The present invention may also be configured such that the field selection signals are generated based on random number sequences output from K taps of the linear feedback shift registers of a plurality of code generators.

The present invention may be configured as: setting K bits of data that each bit is configured based on the random number sequences from K taps as the load value for a field counter; incrementing or decrementing a count value of the field counter from the load value, and resetting the count value to the opposite upper or lower limit value, when the count value reaches an upper limit value or a lower limit value; and generating field selection signals that correspond to the count value of the field counter.

BRIEF DESCRIPTION OF THE DRAWINGS

FIGS. 4(A), (B) and (C) are explanatory diagrams of the MLS computation.

FIG. 11 shows an example of power spectra of COM1 for the comparison example and for the present embodiment.

FIG. 12 shows an example of power spectra of COM2 for the comparison example and for the present embodiment.

FIG. 13 shows an example of power spectra of COM3 for the comparison example and for the present embodiment.

FIG. 14 shows an example of power spectra of COM4 for the comparison example and for the present embodiment.

DETAILED DESCRIPTION

Hereinafter, preferred embodiments of the present invention will be described in detail with reference to the drawings. The embodiments described hereinafter should not be construed to limit the content of the present invention, whose scope is set forth in the claims. Furthermore, not all of the components described hereinafter necessarily represent essential component for the present invention.

1. Electro-Optic Device and Display Driver

Figure 1:
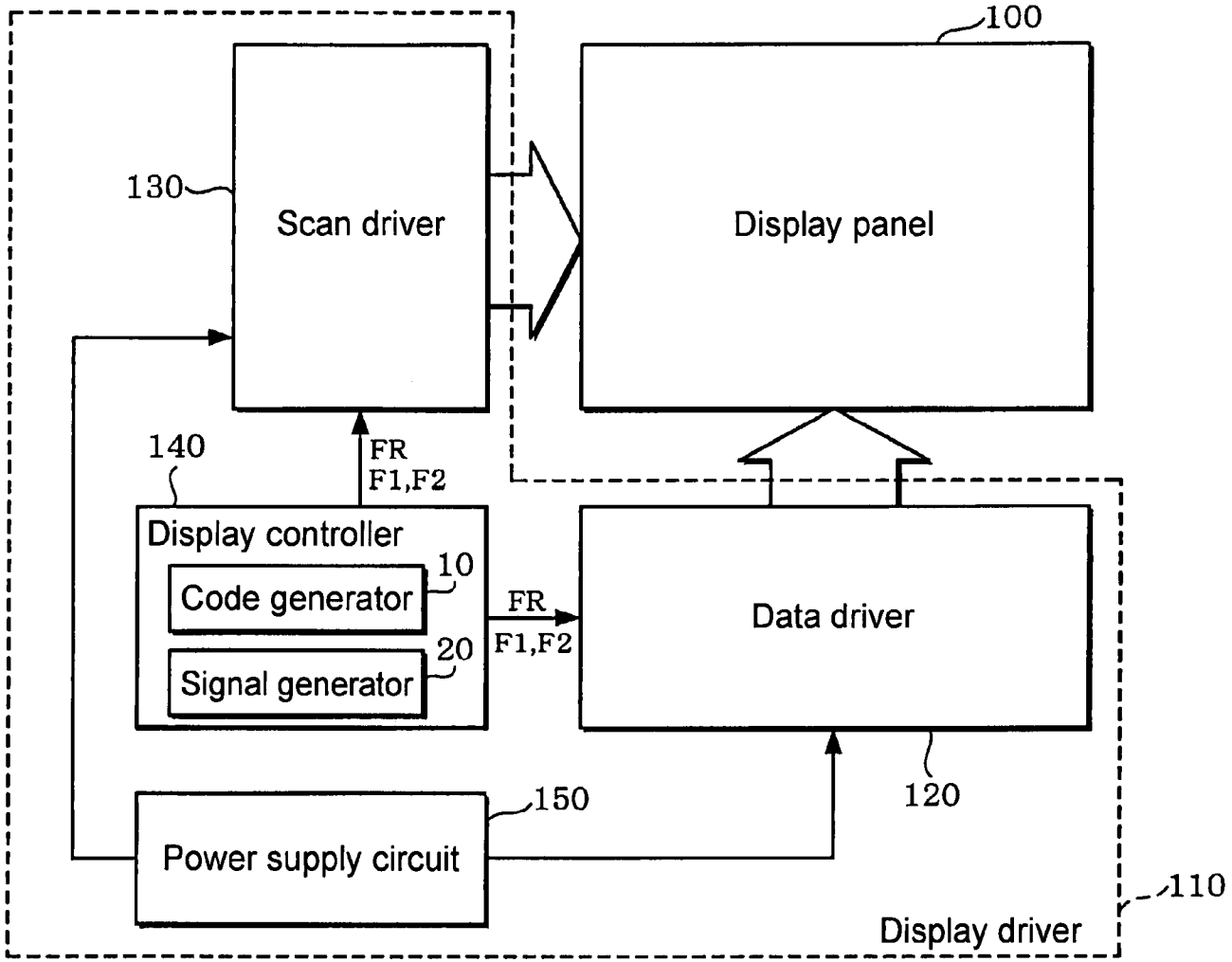
FIG. 1 is an example of the configuration of the electro-optic device and display driver.

FIG. 1 shows an example of the configuration of the electro-optic device and a display driver of the present invention.

The electro-optic device (more particularly, liquid crystal display device) includes a display panel 100 (more particularly, liquid crystal panel) and a display driver 110.

The display panel 100 has a plurality of data lines (segments), a plurality of scan lines (common), and a plurality of picture elements that are determined by the data lines and scan lines. The display panel 100 realizes display operations by varying the optical characteristics of the electro-optic elements (more particularly, liquid crystal elements) in each picture element area.

The display driver 110 drives the display panel 100 by the MLS (multi-line selection) drive method, and includes a data driver 120 (segment driver) and a scan driver 130 (common driver). The data driver 120 drives data lines of the display panel 100 based on display data by a multi-line drive method. The scan driver 130 sequentially scans and drives the scan lines of the display panel 100 while selecting a plurality of scan lines simultaneously.

The display driver 110 includes a display controller 140 (control unit). The display controller 140 performs control or the like of the data driver 120, the scan driver 130 and the power supply circuit 150. More specifically, the display controller 140 supplies various types of control signals (e.g. frame signals FR, field selection signals F1, F2) to the data driver 120 and the scan driver 130, while it supplies instructions regarding power supply settings to the power supply circuit 150. The functions of the display controller 140 can be realized, for example, by ASIC controller circuit. Alternatively, the functions of the display controller 140 may be realized by a general-purpose processor (CPU).

The display controller 140 includes a code generator 10 (random number generating circuit) and a signal generator 20 (signal generating circuit). The code generator 10 generates pseudo random number sequences. More specifically, the code generator 10 (random number generator) has a linear feedback shift register (LFSR), and generates pseudo random number sequences (PN sequences) using the LFSR (shift register comprised of a plurality of registers, cascaded-coupled and having a feedback line for input to registers). As for examples of the pseudo random number (pseudo random) sequences that the code generator 10 generates, M-sequences (Maximal-length-sequences), GOLD sequences or the like can be considered. The display controller 140 may include a plurality of code generators 10.

The signal generator 20 receives random number sequences output from K taps (K being an integer that is two or more, and the taps being output terminals of registers) of the linear feedback shift register included in the code generator 10, and generates field selection signals F1, F2 (signals of K bits) based on the random number sequences. That is, the signal generator 20 generates field selection signals F1, F2 such that field selection sequences vary randomly. The signal generator 20 may generate the field selection signals F1, F2 based on random number sequences output from K taps of the linear feedback shift register of a code generator 10. Alternatively, when the display controller 140 includes a plurality of code generators 10, the display controller 140 may generate the field selection signals based on a plurality of random number sequences (first to $K^{th}$ random number sequence) output from taps of the linear feedback shift registers included in a plurality of code generators (first to $K^{th}$ code generators). The number of bits for the field selection signals is not limited to two, but may be three or more.

The power supply circuit 150 generates various power voltages that are necessary to drive the display panel 100 based on reference voltages supplied from the outside. The generated power voltages are supplied to the data driver 120, the scan driver 130 or the like.

The display driver 110 does not need to include all of the components in FIG. 1, and some of them may be omitted. For example, a configuration of the display driver 110 may not include the data driver 120 or the power supply circuit 150.

2. Data Driver

Figure 2:
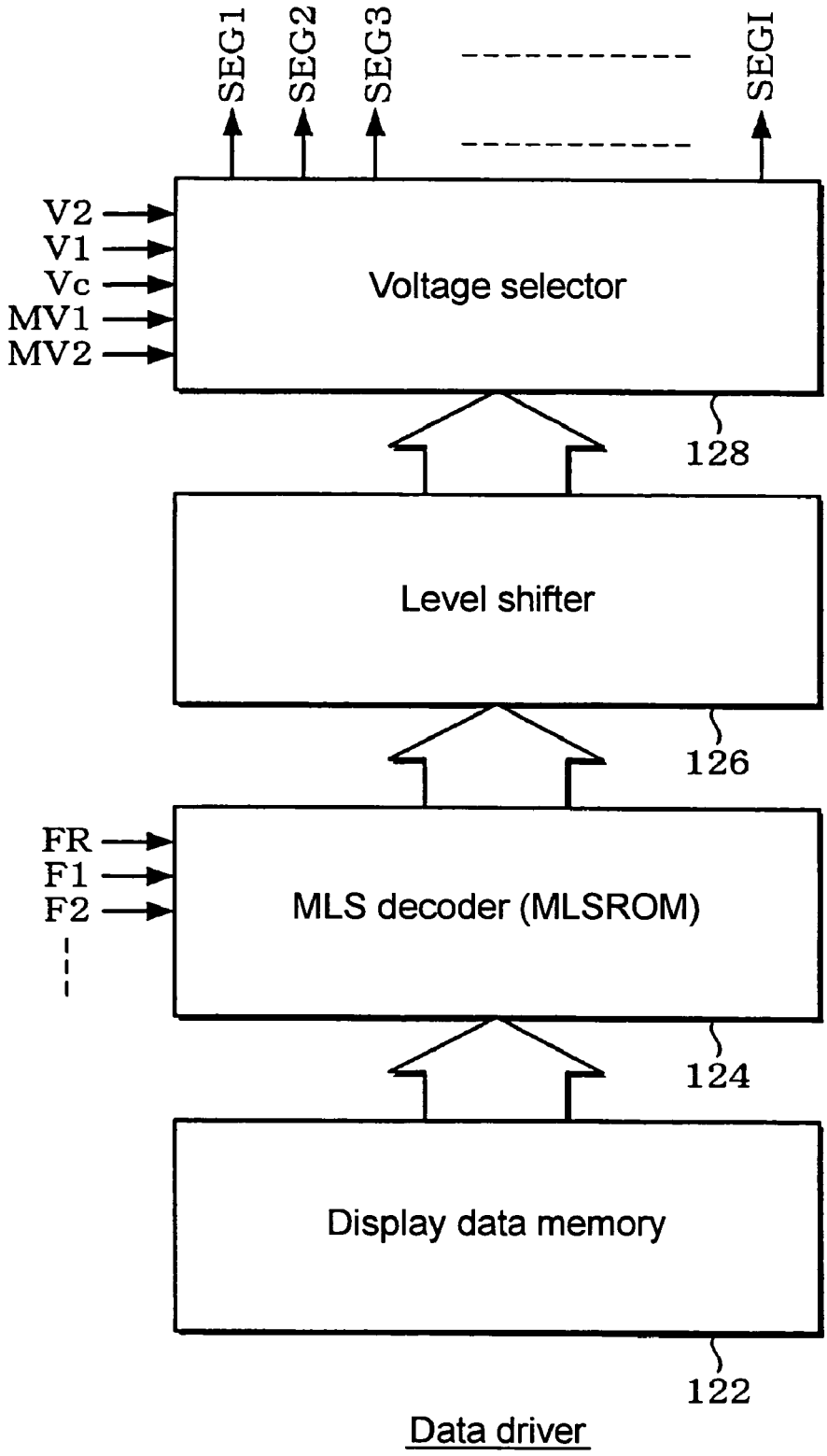
FIG. 2 is an example of the configuration of the data driver.

FIG. 2 shows an example of the configuration of the data driver 120. However, the data driver 120 may take a configuration that some of the components in FIG. 2 are omitted.

The data driver 120 includes a display data memory 122 (display data RAM), in which display data of a screen, including a plurality of screens, are memorized. Writing and reading of the display data is controlled by, for example, the display controller 140 in FIG. 1. The data driver 120 (display driver 110) may take a configuration that does not include the display data memory 122.

The data driver 120 also includes an MLS decoder 124. The MLS decoder 124 performs MLS computation based on display data from the display data memory 122 and control signals (FR, F1, F2) from the display controller 140 so as to determine the voltage levels of the data signals to be applied to the data lines (SEG1 to SEGl) in each field of the each frame. The MLS computation in the MLS decoder 124 may be realized by a combinational logic circuit for performing MLS computation, or by an ROM that outputs MLS computation results corresponding to the display data.

The data driver 120 further includes a level shifter 126 and a voltage selector 128 (drive circuit). The level shifter 126 receives the output signal from the MLS decoder 124, converts the voltage level of the output signal, and outputs it to the voltage selector 128. The voltage selector 128 selects the voltage that corresponds to the result decoded by the MLS decoder 124 from voltages V2, V1, VC, MV1 and MV2 from the power supply circuit 150, and outputs it to the data lines.

3. Scan Driver

Figure 3:
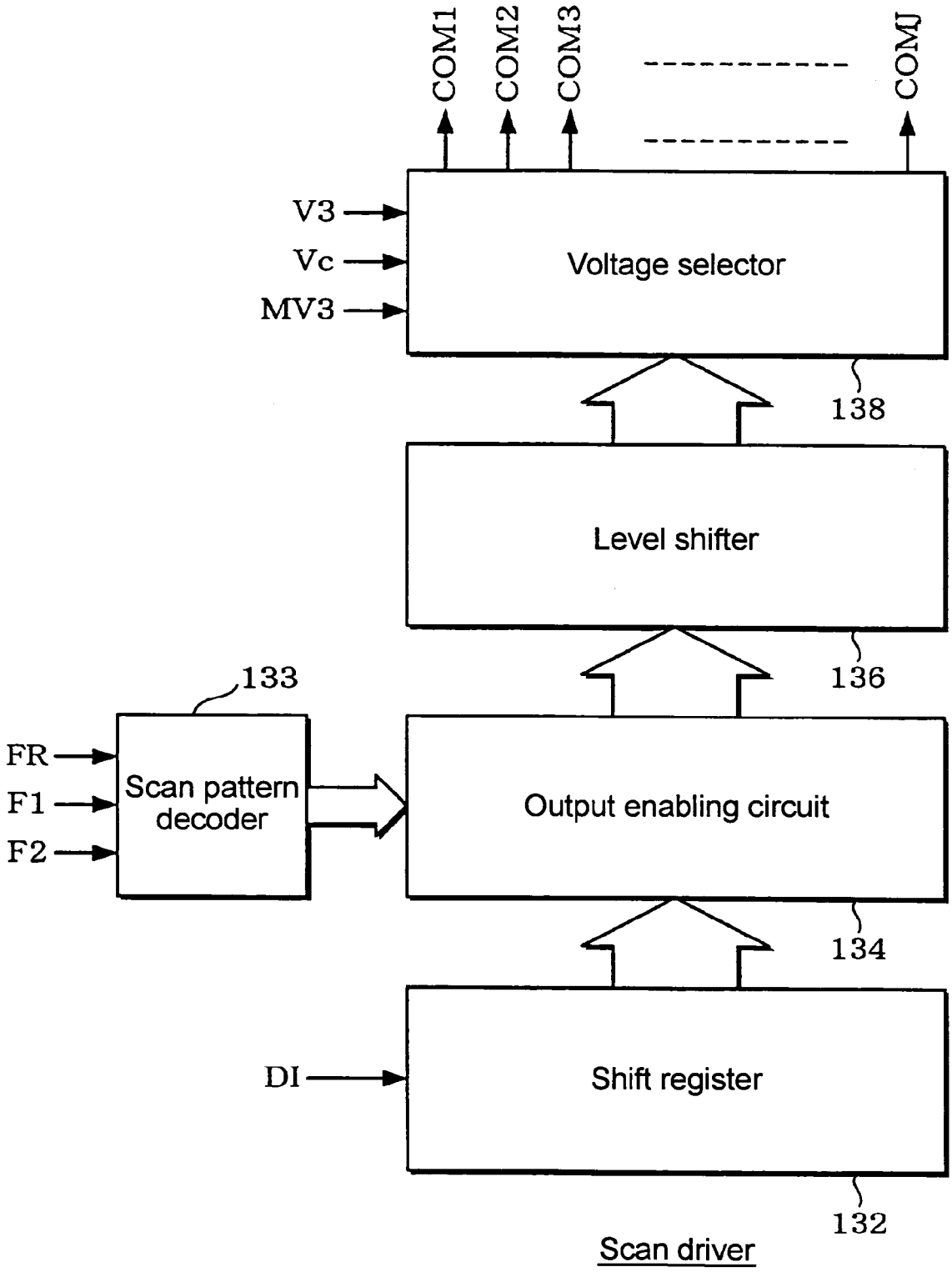
FIG. 3 is an example of the configuration of the scan driver.

FIG. 3 shows an example of the configuration of the scan driver 130. However, the scan driver 130 may take a configuration that some of the components in FIG. 3 are omitted.

The scan driver 130 includes a shift register 132. The shift register 132 sequentially shifts a one-bit signal DI that is input to the start register. In the case of simultaneous selection of four scan lines, for example, the shift register 132 shifts DI by one-bit for each time when four lines are simultaneously selected. For example, when signal DI is input to the shift register 132 for each field, the shift register 132 repeats the shift operation for each field (in the case of full distribution).

The scan driver 130 also includes a scan pattern decoder 133 and an output enable circuit 134. The scan pattern decoder 133 receives control signals (FR, F1, F2) from the display controller 140, and determines the voltage levels of the scan signals to be applied to the scan lines (COM1 to COMJ) in each field of each frame. The output enabling circuit 134 receives the signal from the scan pattern decoder 133 and the shift output signal from the shift register 132, and performs an output enable control of the scan signals (selection signals) to the scan lines.

The scan driver 130 further includes a level shifter 136 and a voltage selector 138 (drive circuit). The level shifter 136 receives the output signal from the output enable circuits 134, converts the voltage level of the output signal, and outputs it to the voltage selector 138. The voltage selector 138 selects the voltage that corresponds to the result decoded by the scan pattern decoder 133 from voltages V3, VC and MV3 from the power supply circuit 150, and outputs it to the scan lines.

4. MLS Computation

FIG. 4(A) shows sample waveforms (common waveforms) for the scan signals that are applied to the scan lines (COM1 to COM4) in each of the fields 1F to 4F, which is made by dividing a single frame, for the MLS drive for simultaneous selection of four lines. FIG. 4(C) shows an example of the MLS computation for implementing a display shown in FIG. 4(B). The MLS computation is performed by the MLS decoder 124 in FIG. 2.

Four-row, four-column orthogonal matrixes labeled A1 and A2 in FIG. 4(C) correspond to the waveforms of scan signal in FIG. 4(A). The elements in the first, second, third and fourth rows of the matrixes correspond to the waveforms COM1, COM2, COM3 and COM4 in FIG. 4(A), respectively. As for the each element of the matrix, the element "1" represents a selection of the high potential voltage (V3) and the element "−1" represents a selection of the low potential voltage (MV3).

In FIG. 4(B), the black circle signifies a black display and the white circle signifies a white display. In FIG. 4(C), a single-row, four-column matrix labeled A3 corresponds to SEG1 of FIG. 4(B) and a single-row, four-column matrix labeled A4 corresponds to SEG2 of FIG. 4(B). As for the each element of the matrix, the element "−1" represents a black circle, i.e. black display, and the element "1" represents a white circle, i.e. white display.

By performing matrix computations using the matrixes, the levels of voltage to be applied to the data lines in each field are determined. For example, the matrix calculation results labeled A5 in FIG. 4(C) indicate that the voltages VC, VC, MV2 and VC should be applied to fields 1F, 2F, 3F and 4F, respectively, in SEG1. While the matrix calculation results labeled A6 in FIG. 4 (C) indicate that the voltages MV1, V1, MV1 and V1 should be applied to fields 1F, 2F, 3F and 4F, respectively, in SEG2.

Figure 5:
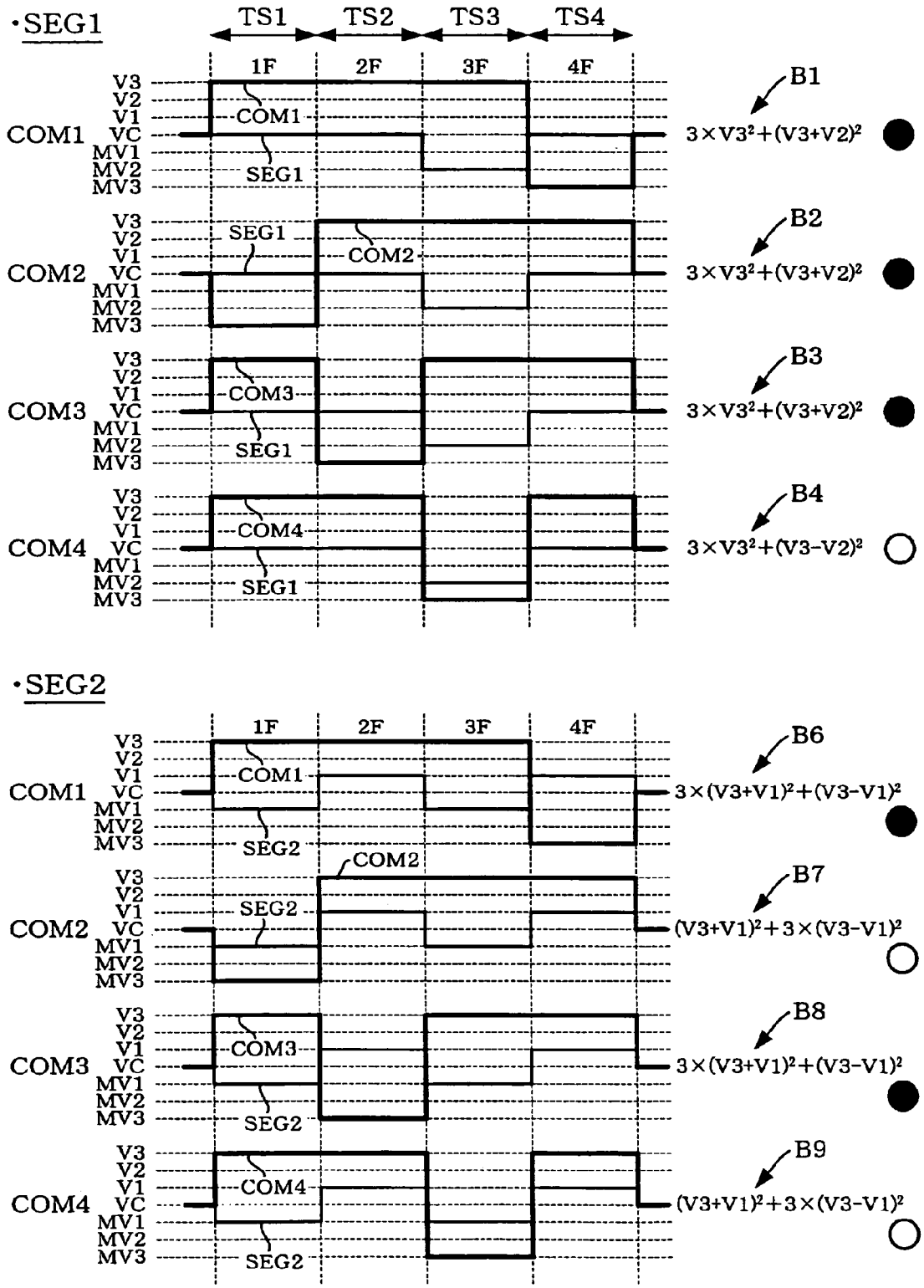
FIG. 5 shows sample waveforms of the scan signals and the data signals by the MLS drive method.

FIG. 5 shows sample waveforms for the data signals to be applied to SEG1 and SEG2, and for the scan signals to be applied to COM1 to COM4, when the MLS computation in FIG. 4(C) is performed. Note that FIG. 5 shows only the waveforms during the selection period (TS in FIG. 4(A)) and omits waveforms during the non-selection period (TN in FIG. 4(A)).

B1 to B9 in FIG. 5 show the results of computation of the effective values of the voltages applied to the liquid crystals (more broadly, display element) in a single frame. It can be understood from the computation results that the black displays and white displays shown in FIG. 4(B) are correctly implemented in data lines SEG1 and SEG2.

FIG. 4(A), (B) and FIG. 5 show the case where four scan lines are selected simultaneously, but the number of scan lines that are selected simultaneously may be two or three, or five or more.

Figure 6A:
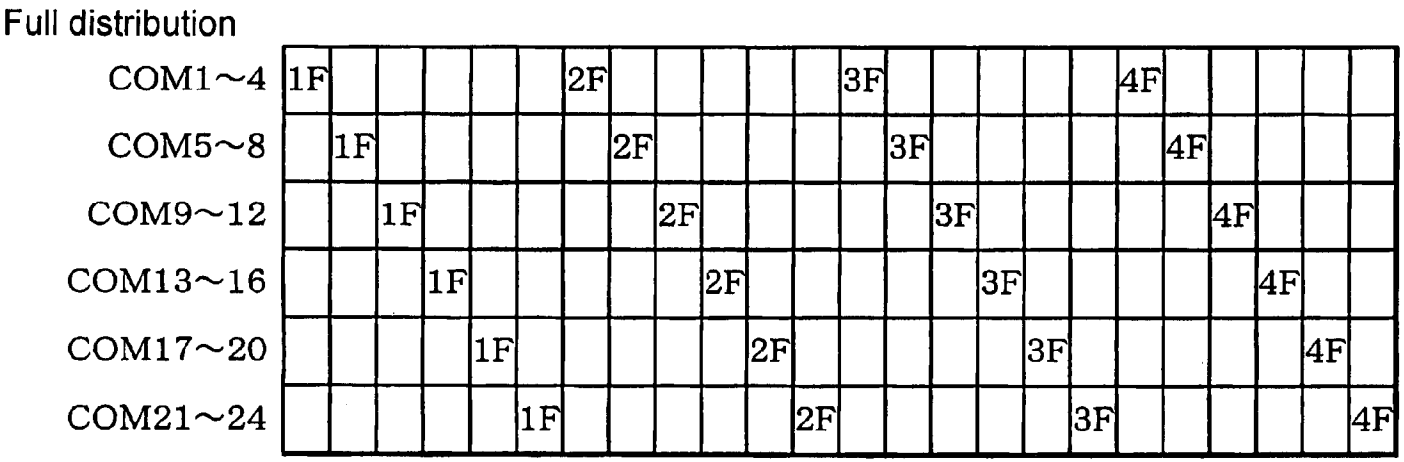
FIGS. 6(A) and (B) are explanatory diagrams of the distribution drive for the MLS.
Figure 6B:
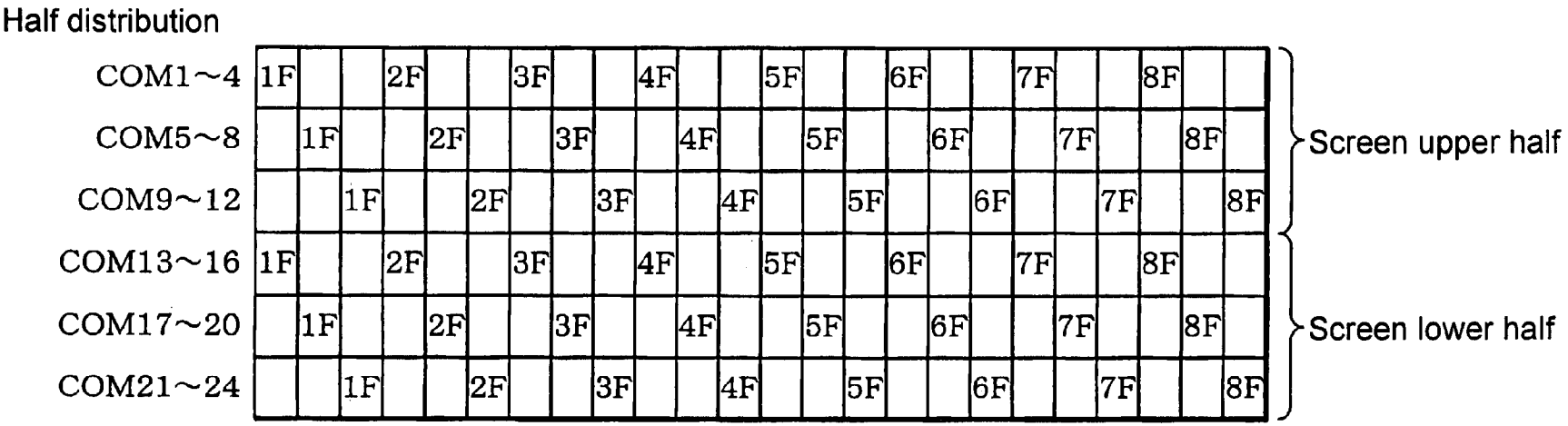

Furthermore, various methods can be considered for the distribution method of fields to the frame. FIG. 6(A) shows an example of the full distribution drive. FIG. 6(B) shows an example of the half distribution drive. In the full distribution of FIG. 6(A), a drive by the data of 1 field (1F) to 4 field F) is implemented by distribution within a screen (frame). That is, the screen is driven from top to bottom using the data for the first field, then driven from top to bottom using the data for the second field, after which it is driven from top to bottom using the data for the third field, and finally driven from top to bottom using the data for the fourth field. Whereas with the half distribution drive of FIG. 6(B), a full distribution drive is implemented separately in the upper half and lower half of a screen.

More specifically, as for the full distribution of FIG. 6(A), the scan lines are divided into scan line groups COM1 to 4, COM5 to 8, COM9 to 12, COM13 to 16, COM17 to 20, and COM21 to 24. And each of the grouped scan line groups is selected simultaneously. For example, in the first field, the scan line group is selected in the sequence COM1 to 4, COM5 to 8, COM9 to 12, COM13 to 16, COM17 to 20, and COM21 to 24 so as to apply scan signals and data signals with the waveforms of period TS1 in FIG. 5 to the scan lines and data lines. Then the scan line group in the second field is selected in the same sequence COM1 to 4, COM5 to 8, COM9 to 12, COM13 to 16, COM17 to 20, and COM21 to 24 so as to apply scan signals and data signals with the waveforms of period TS2 in FIG. 5 to the scan lines and data lines. The same process is applied to the third and fourth fields.

5. Streak-like Display Irregularities

Figure 7A:
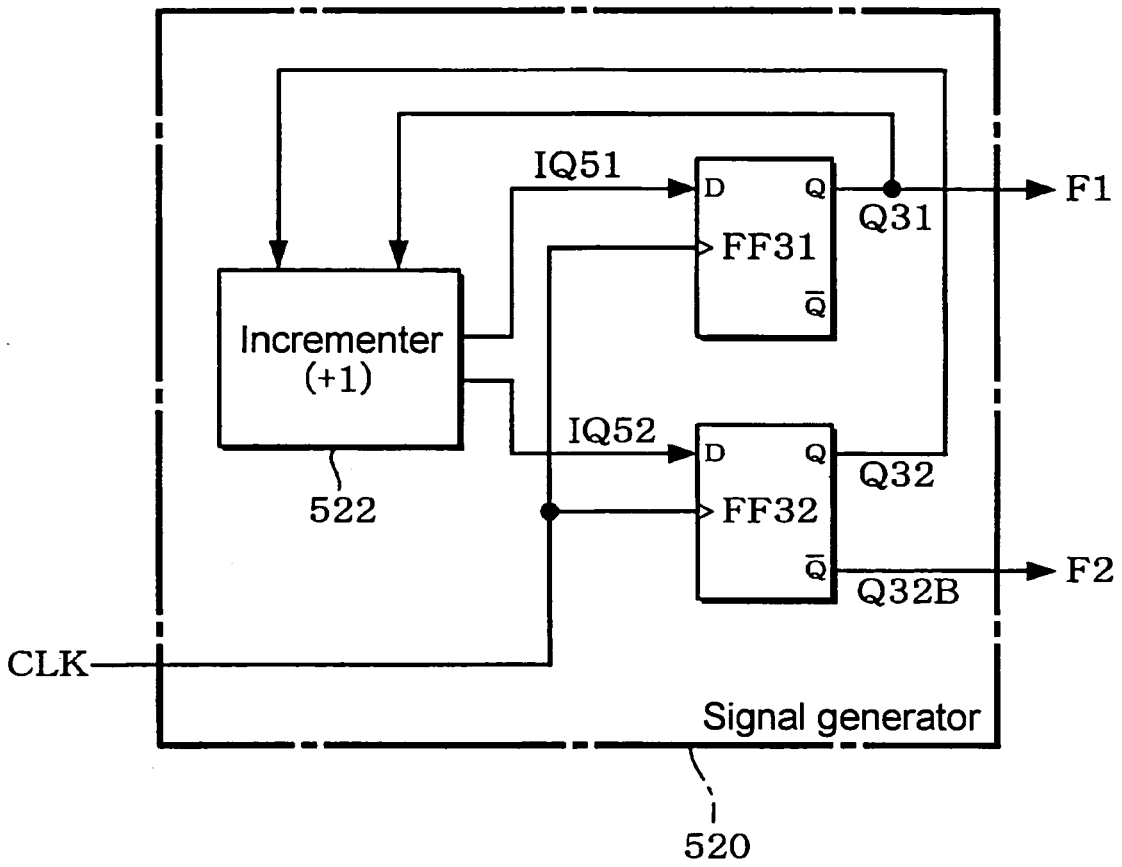
FIGS. 7(A) and (B) are explanatory diagrams of the comparison example.

FIG. 7(A) shows an example of a signal generator 520 of a comparison example that generates field selection signals F1 and F2. The signal generator 520 has flip-flops FF31 and FF32 (registers), and an incrementer 522.

The flip-flops FF31 and FF32 are reset by a reset signal (not shown), and the initial count value "0" is set for the both flip-flops. Output signals Q31 and Q32 from FF31 and FF32 are input to the incrementer 522. The incrementer 522 performs a process that increments the two-bit count value CT expressed by the signals Q31 and Q32 by an amount such as "+1", then signals IQ51 and IQ52, which express the incremented two-bit count value CT, are transmitted from the incrementer 522 to the data terminals of the flip-flops FF31 and FF32. Following that, the output signal Q31 of FF31 and an inverted output signal Q32B of FF32 are output as the field selection signals F1 and F2, respectively. The count value CT of the flip-flops FF31 and FF32 are reset by a reset signal (not shown) whenever they reaches "3".

Figure 7B:
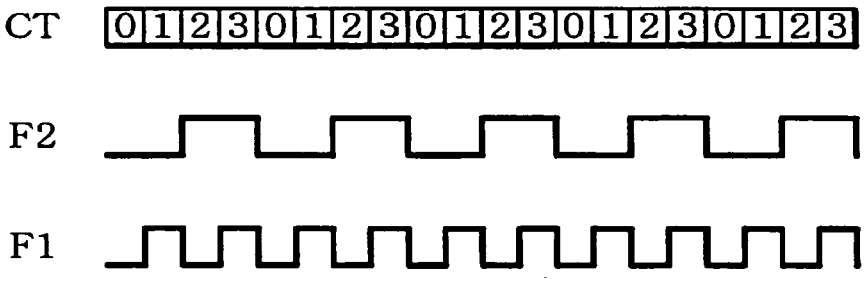

FIG. 7(B) shows a sample waveform for the signal generated by the signal generator 520. As shown in FIG. 7(B), the count value CT of the field counter, constituted by the flip-flops FF31, FF32 and the incrementer 522, is incremented in a sequence of "0", "1", "2", and "3", and after that it is reset to "0", and the incrementation and resetting are repeated. The signal generator 520 outputs the field selection signals F1 and F2 corresponding to the count value CT.

For example, if F1 and F2 are both "0", the field 1F is selected, while if F1 and F2 are "1" and "0", respectively, the field 2F is selected. If F1 and F2 are "0" and "1", respectively, the field 3F is selected, while if F1 and F2 are both "1", the field 4F is selected.

When the field selection signals F1 and F2 generated by the signal generator 520 shown in FIG. 7 were used to implement the MLS drive, the occurrence of streak-like display irregularities along the scan lines has been found.

Figure 8A:
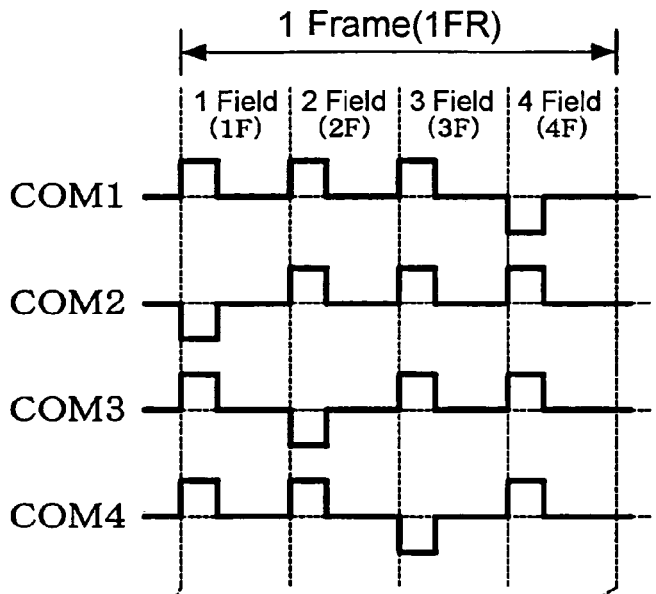
FIGS. 8(A) and (B) are explanatory diagrams showing the problems of the comparison example.

This may be explained as follows. Frame inverting drive is implemented in liquid crystal panels in order to prevent direct-current voltage from being applied to the liquid crystals and causing them to seize up. For example, based on the frame signal FR (alternating signal for drive), the polarity of voltages applied to the scan lines and data lines are inverted frame-by-frame using a center voltage VC as the reference. For example, the polarity of a scan signal waveform shown in FIG. 8(A) is inverted frame-by-frame using a center voltage VC (reference voltage for polarity inversion) as the reference as shown in FIG. 8(B).

Figure 8B:
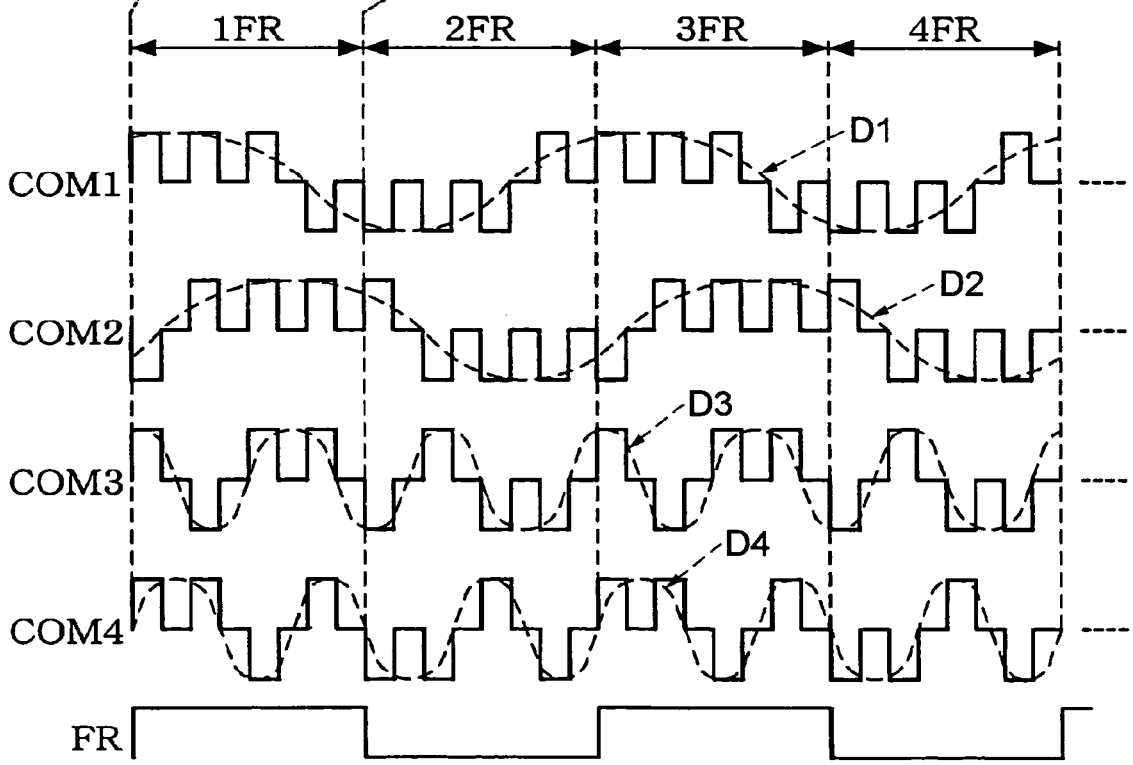

In this case, low frequency components labeled D1 and D2 in FIG. 8(B) appear in the waveforms of COM1 and COM2, while high frequency components labeled D3 and D4 appear in the waveforms of COM3 and COM4. The difference between these frequency components causes the streak-like display irregularities to occur in the display panel.

6. Code Generator

Figure 9:
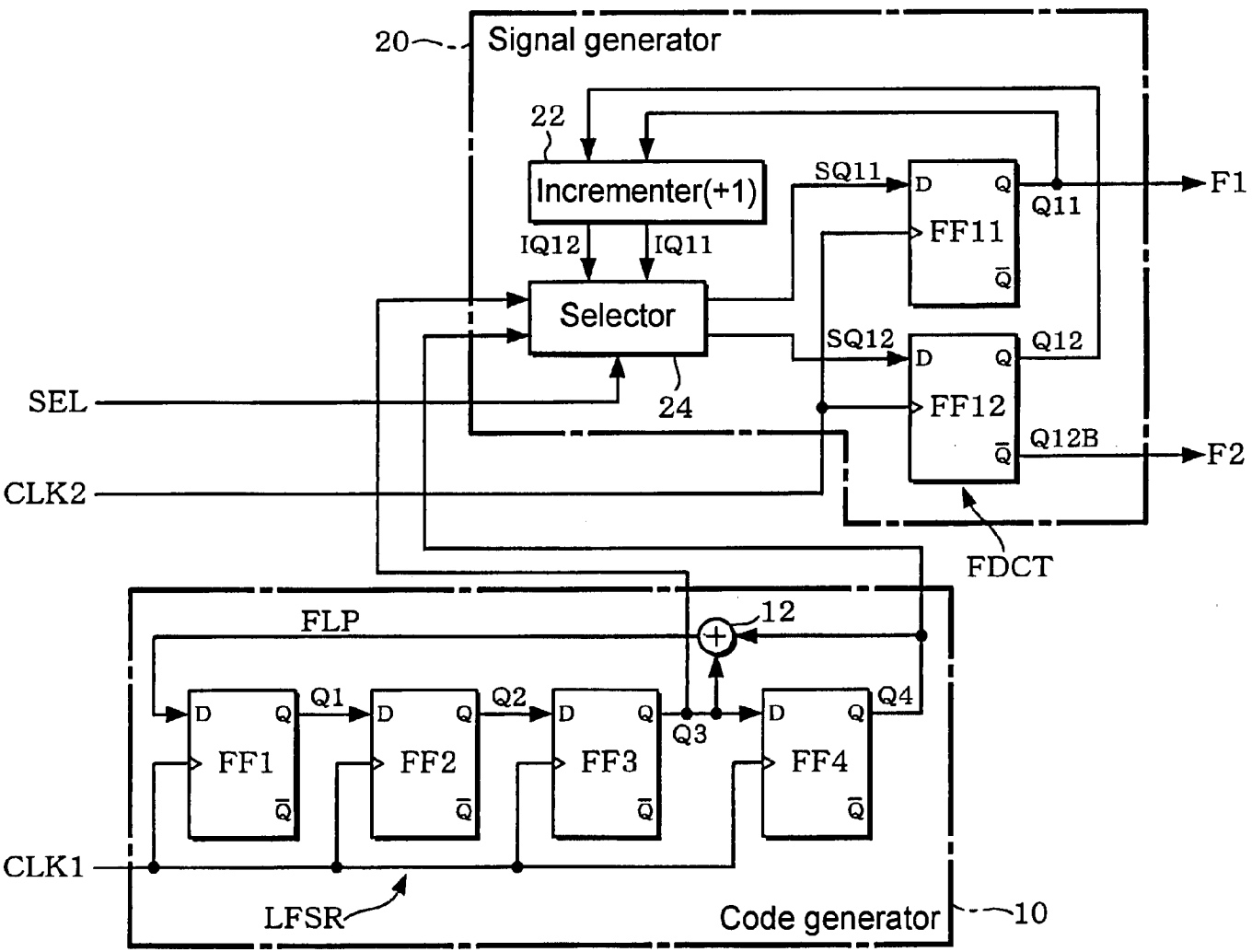
FIG. 9 is an explanatory diagram of the code generator and the signal generator of the present embodiment.

In order to solve the above problem, in the present embodiment, a code generator 10 shown in FIG. 1 is provided. Based on random number sequences (dispersion code sequences) generated by the code generator 10, the signal generator 20 generates field selection signals that vary field selection sequences randomly. With this process, frequency dispersion of the frequency components (D1 to D4 in FIG. 8(B)) that appear in the MLS drive patterns becomes possible, thereby the occurrence of streak-like display irregularities can be prevented. FIG. 9 shows an example of configurations for the code generator 10 and the signal generator 20. Configurations that omit some of the components in FIG. 9 may be used.

The code generator 10 (pseudo random number generator) includes the flip-flops FF1 to FF4 (more broadly, means of retaining shift values). The four flip-flops FF1 to FF4 (more broadly, N flip-flops, N being an integer that is two or more) are shift registers, which are cascaded-coupled. Together with an adder 12 (exclusive-OR gate) and a feedback loop FLP, the flip-flops FF1 to FF4 compose a linear feedback shift register LFSR.

More specifically, an output signal (tap) Q3 of FF3 and an output signal (tap) Q4 of FF4 are input to the adder 12, and an output signal (FLP) from the adder 12 is fedback and input to the data terminal of the flip-flop FF1, which is a first stage of the flip-flops. In each of FF1 to FF4, either "0" or "1" is set as the initial value by resetting and setting by reset signals and set signals (not shown). With the shift operation of FF1 to FF4, based on a clock CLK1, a pseudo random number sequence of M-sequence is generated in the tap of Q4 of FF4, and another pseudo random number sequence of M-sequence is generated in the tap of Q3 of FF3.

The signal generator 20 receives pseudo random number sequences (random number sequences of K bits) that are generated in the taps Q3 and Q4, and generates the field selection signals F1 and F2 that vary field selection sequences randomly (pseudo-randomly).

More specifically, the signal generator 20 includes flip-flops FF11 and FF12 (more broadly, means of retaining count values). Together with an incrementer 22 and a selector 24, the flip-flops FF11 and FF12 constitute a field counter FDCT.

The field counter FDCT executes counting operations based on a clock CLK2. The clock CLK2 has a cycle that is, for example, four times (more broadly, N times) longer than that of the clock CLK1 of the code generator 10. The output signals Q11 and Q12 from the flip-flops FF11 and FF12 are input to the incrementer 22.

The incrementer 22 performs a process that increments the two-bit (more broadly, K-bit) count value CT expressed by the signals Q11 and Q12 by an amount such as "+1". Then signals IQ11 and IQ12 corresponding to the incremented two-bit count values CT are input from the incrementer 22 to the selector 24.

The random number sequences from the taps of Q3 and Q4 of flip-flops FF3 and FF4, in addition to the signals IQ11 and IQ12 from the incrementer 22 are input to the selector 24. At first, the selector 24 selects the signals Q3 and Q4 (load values according to random number sequences) from FF3 and FF4, and outputs the selected signals Q3 and Q4 as signals SQ11 and SQ12 to the data terminals of FF11 and FF12. Then when the count values CT, which are the retained values of FF11 and FF12, are incremented by the incrementer 22, the selector 24 selects the signals IQ11 and IQ12 corresponding to the incremented count values CT, and outputs the selected IQ11 and IQ12 to FF11 and FF12.

In the time until the next load value (initial value) is loaded, the selector 24 selects the signals IQ11 and IQ12 and outputs them to FF11 and FF12. When the time for loading the next load value comes, the selector 24 selects the signals Q3 and Q4 from FF3 and FF4 and outputs them to FF11 and FF12. With this process, the count values of FF11 and FF12 are reset to the load values (load values based on random number sequences) determined by Q3 and Q4. The selection operation of the selector 24 is controlled by a signal SEL.

Then as shown in FIG. 9, an output signal Q11 of FF11 and an inverted output signal Q12B of FF12 are output as the field selection signals F1 and F2. Thus the field selection signals F1 and F2 that randomly vary the selection of the fields are generated.

The count value CT of the field counter FDCT is reset to "0" (the lower limit value) by a reset signal (not shown) each time it reaches "3" (the upper limit value). FIG. 9 shows the case where an incrementer 22 is used, but a decrementer may be used in place of the incrementer 22 so as to perform decrementation processing of the count value CT. In the latter case the count value CT of FF11 and FF12 is set to "3" (the upper limit value) by a set signal (not shown) for each time when it reaches "0" (the lower limit value).

Thus, in the field counter FDCT of FIG. 9, two-bit (more broadly, K-bit) data, in which each bit is configured based on random number sequences from two taps (more broadly, K taps) of the LFSR of the code generator 10, are set as the load value. The FDCT performs incrementation (or decrementation) of the count value CT using the load value as an initial value, and when the count value CT reaches the upper limit value "3" (or the lower limit value "0"), the FDCT resets the count value CT to the lower limit "0" (or the upper limit "3"). Then, the signal generator 20 generates and outputs the field selection signals F1 and F2 based on the count value CT of the FDCT.

Figure 10:
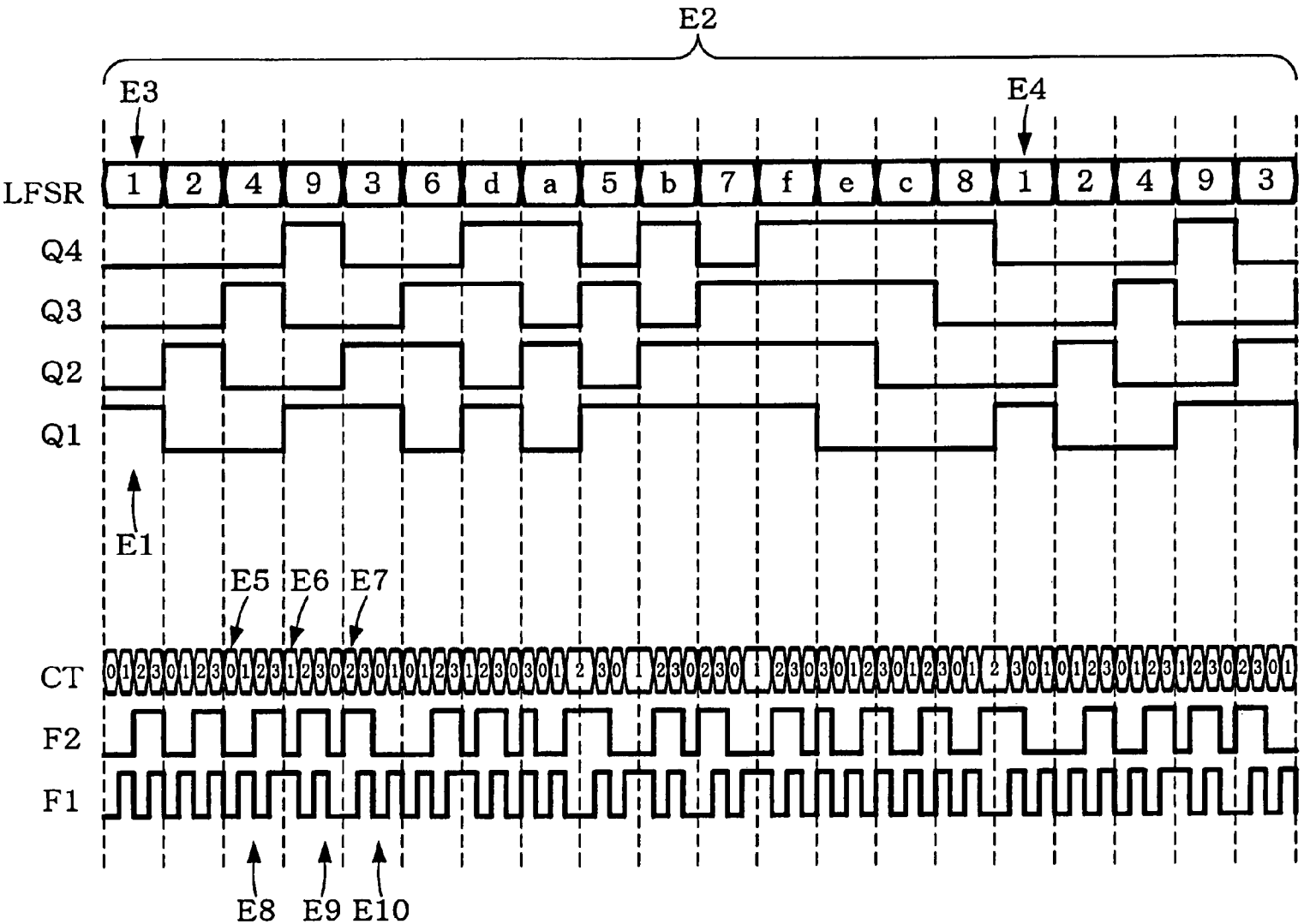
FIG. 10 shows sample waveforms for various signals of the code generator and the signal generator.

FIG. 10 shows sample waveforms for various signals generated by the code generator 10 and signal generator 20 in FIG. 9. An initial value (Q1, Q2, Q3, Q4)=(1, 0, 0, 0) is set for the linear feedback shift register LFSR based on the timing labeled E1 in FIG. 10. This is realized by setting and resetting the retained values of the LFSR based on set or reset signals (not shown).

Following that, the LFSR executes shift operation, and the hexadecimal data expressed by the retained values (Q1 to Q4) of the LFSR are varied randomly so as to produce a sequence such as "1", "2 ", "4", "9", "3" . . . in the manner shown in E2. Because these data do not constitute a true random number sequence, but rather a pseudo random number sequence, the random number sequence is iterated with a predetermined period (a period of 15 cycles in FIG. 10) indicated by E3 and E4.

Two-bit data, in which each bit is configured based on the random number sequences generated in the taps Q3 and Q4 of the LFSR, are set as the load values for the field counter FDCT included in the signal generator 20.

For example, at E5 in FIG. 10, a load value of "0" is set for the field counter FDCT. And the FDCT increments the count value CT in a sequence "0 ", "1", "2", and "3".

Meanwhile, at E6 in FIG. 10, a load value of "1" is set for the FDCT. And the FDCT increments the count value CT in a sequence "1", "2", "3". When the count value CT reaches "3", the upper limit value, CT is reset to the lower limit value "0". In such a way, the count value CT changes in a sequence "1", "2", "3", "0".

Further, at E7 in FIG. 10, a load value of "2" is set for the FDCT. And the FDCT increments the count value CT in a sequence "2", "3". When the count value CT reaches the upper limit value "3", CT is reset to the lower limit value "0", and is subsequently incremented in a sequence "0", "1". In such a way, the count value CT changes in a sequence "2", "3", "0", "1".

When CT changes in the sequence "0", "1", "2", "3" as shown at E1 in FIG. 10, the field selection signals F1 and F2 change in a manner shown at E8, so that the fields are selected in a sequence 1F, 2F, 3F, 4F. That is, the field 1F is selected when (F1, F2)=(0, 0), the field 2F is selected when (F1, F2)=(1, 0), the field 3F is selected when (F1, F2)=(0, 1), and the field 4F is selected when (F1, F2)=(1, 1). Then voltages shown in FIG. 5 are applied to the scan lines (COM1 to COM4) and data lines (SEG1, SEG2) in each of the fields 1F, 2F, 3F and 4F, thereby realizing a distribution drive by the MLS.

Similarly, as CT changes in the sequence "1", "2", "3", "0" at E6 in FIG. 10, the field selection signals F1 and F2 change in the manner shown at E9, so that the fields are selected in a sequence 2F, 3F, 4F, 1F. Then voltages for each field shown in FIG. 5 are applied to each of the fields 2F, 3F, 4F and 1F.

When CT changes in the sequence "2", "3", "0", "1" at E7 in FIG. 10, the field selection signals F1 and F2 change in the manner shown at E10, so that the fields are selected in a sequence 3F, 4F, 1F, 2F. Then voltages for each field shown in FIG. 5 are applied to each of the fields 3F, 4F, 1F and 2F.

Accordingly, as for the present embodiment, the field selection sequences vary randomly based on random number sequences generated by the code generator 10 (LFSR). Therefore, frequency dispersion of frequency components in the MLS drive pattern such as D1 to D4 in FIG. 8 can be performed. As a result, the occurrence of streak-like display irregularities along the scan lines can be prevented effectively.

FIGS. 11 to 14 show power spectra for COM1 to COM4 obtained by: running circuit simulations for the display driver of the present embodiment; recording the output voltages of the terminals of COM1 to COM4; and performing FFT (Fast Fourier Transform) analysis on the recorded output voltages. The power spectrum on the upper side in FIGS. 11 to 14 show cases where the field selection signals F1, F2 were generated by the signal generator 520 of the comparison example in FIG. 7(A), while the power spectrum on the lower side in FIGS. 11 to 14 show cases where the field selection signals F1, F2 were generated by the code generator 10 and the signal generator 20 of the present embodiment in FIG. 9.

As shown in the power spectra of upper side in FIGS. 11 to 14, in the comparison example of FIG. 7(A), peaks occur in the power spectrum at a plurality of frequencies, and the peaks cause the occurrence of streak-like display irregularities.

By contrast, in the present embodiment, as shown in the power spectra on the lower side in FIGS. 11 to 14, the peaks in the power spectrum that occurred in the comparison example are substantially eliminated by being subjected to frequency dispersion. Therefore, the occurrence of streak-like display irregularities can be prevented.

Moreover, as a comparison of the present embodiment in FIG. 9 with the comparison example in FIG. 7(A) makes clear, the present embodiment realizes the frequency dispersion by just adding a small-sized code generator 10 along with the addition of a selector 24 to the signal generator 20.

As for an example of a method differing from the present embodiment, a method of re-ordering field selection for a plurality of frames at the same time may be considered. However, such a method necessitates a counter for determining the frames on which field selection re-ordering is to be implemented, a counter for setting the period for re-ordering, and a combinational logic circuit for executing logical computations based on the count values from such counters, thereby a large-scale circuit is required. Furthermore, because the field selection re-ordering patterns must be changed for each model display driver, the design of the circuit becomes complicated. Obtaining the optimal frequency dispersion shown in the power spectra of lower side in FIGS. 11 to 14 also becomes difficult.

By contrast, according to the present embodiment, the code generator 10 can be composed of four flip-flops FF1 to FF4 and a one-bit adder 12 as shown in FIG. 9, thus frequency dispersion with a small-sized configuration can be realized. As for the code generator 10 that generates M-sequences, random number sequences with a maximally long period can be obtained for an LFSR of a given length. Moreover, according to the present embodiment, despite such a small-sized configuration, obtaining the optimal frequency dispersion shown in the power spectra of lower side in FIGS. 11 to 14 becomes possible. Additionally, in FIG. 9, the load values for the field counter FDCT is set based on random number sequences from two (more broadly, K) taps of the code generator 10. In such a way, an increase in the circuit size of the display driver by adding the code generator 10 can be suppressed to a minimum level.

A variety of configurations can be employed for the code generator 10. FIG. 9 shows the case where a four-bit LFSR is employed in the code generator 10, but the number of bits of the LFSR is not limited to such a case, but may be two or three, or else five or more.

Figure 15A:
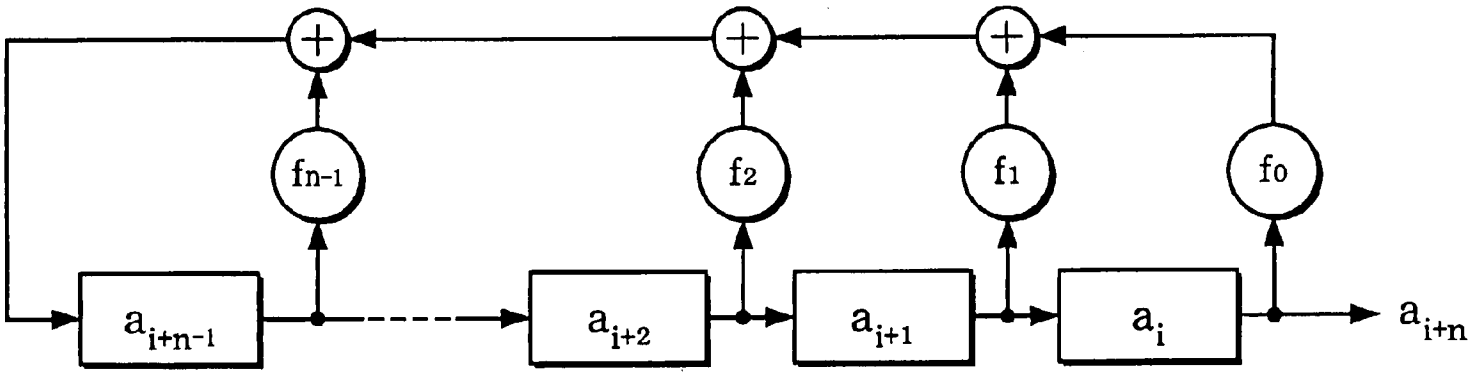
FIGS. 15(A), (B) and (C) are explanatory diagrams of the code generator.

FIG. 15(A) shows an example of a typical configuration for a code generator employing an LFSR (shift register type code generator). As for the code generator 10 of the present embodiment, various configurations such as a typical one shown in FIG. 15(A) can be employed. For example, as an alternative to a code generator utilizing M-sequences, or a code generator utilizing GOLD sequences may also be employed.

The sequences generated by the code generator shown in FIG. 15(A) can generally be expressed as in Equation (1).

Equation 1

$$a_{i+n} = \sum_{j=0}^{n-1} f_j a_{i+j} \tag{1}$$

By setting $f_n=1$ for Equation (1), Equation (2) is obtained as follow.

Equation 2

$$\sum_{j=0}^{n-1} f_j a_{i+j} = 0 \tag{2}$$

Above Equation (2) is termed as a "linear recursive equation", which generates sequences. By introducing a delay operator such as $a_{i+j}=X^j a_i$ into Equation (2), Equation (3) is obtained as follow.

Equation 3

$$\left(\sum_{j=0}^{n-1} f_j x^j\right) a_i = 0 \tag{3}$$

The polynomial equation given by following Equation (4) is called as "characteristic polynomial equation".

Equation 4

$$f(x) = \sum_{j=0}^{n-1} f_j x^j (f_0 \neq 0,\ f_n = 1) \tag{4}$$

As in the case of M-sequences, to maximize the length of the sequences relative to the length of the LFSR, the characteristic polynomial equation must be a primitive polynomial equation.

Figure 15B:
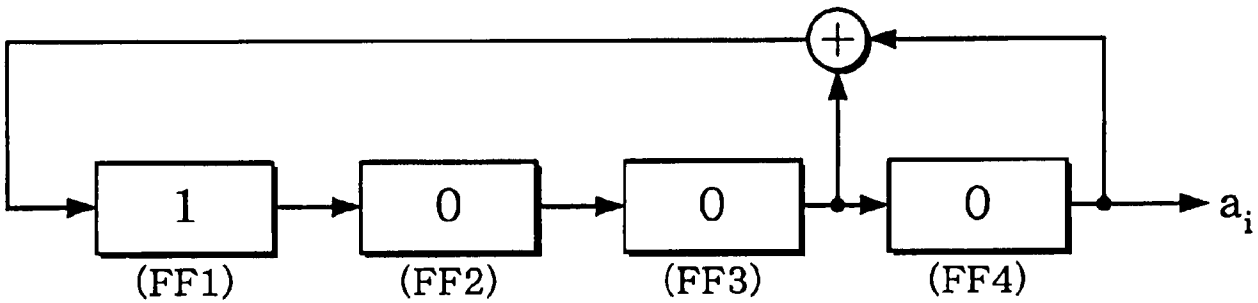
Figure 15C:
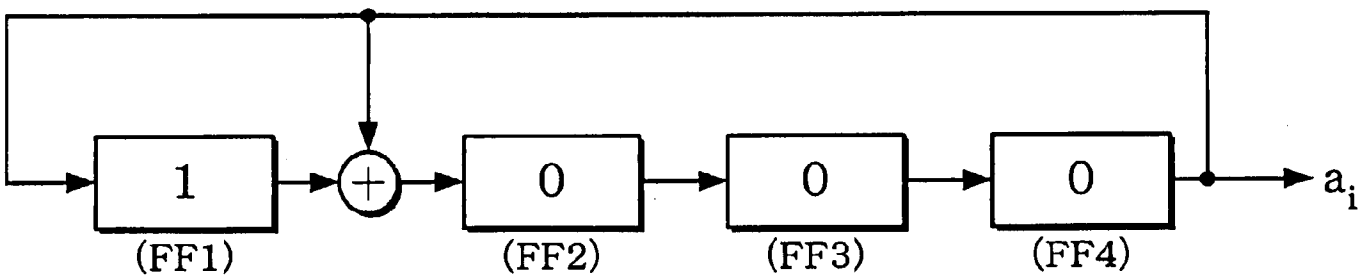

If $f(x)=x^4+x+1$ is employed as a quartic primitive polynomial equation, the code generator has a configuration shown in FIG. 15(B). The quartic M-sequence code generator in FIG. 15(B) is equivalent to the code generator 10 in FIG. 9. For the same quartic M-sequences as in FIG. 15(B), the code generator can take the configuration shown in FIG. 15(C). Thus, the code generator 10 of the present embodiment may take not only the configuration shown in FIG. 15(B), but also the configuration shown in FIG. 15(C).

Additionally, in FIG. 9, the field selection signals are generated based on random number sequences output from two taps of the linear feedback shift registers LFSR of the code generator 10 (taps for K registers, adjacent each other and composing the LFSR). However, the field selection signals may alternatively be generated based on random number sequences output from two taps (K taps) of the linear feedback shift registers of a plurality of code generators.

Figure 16:
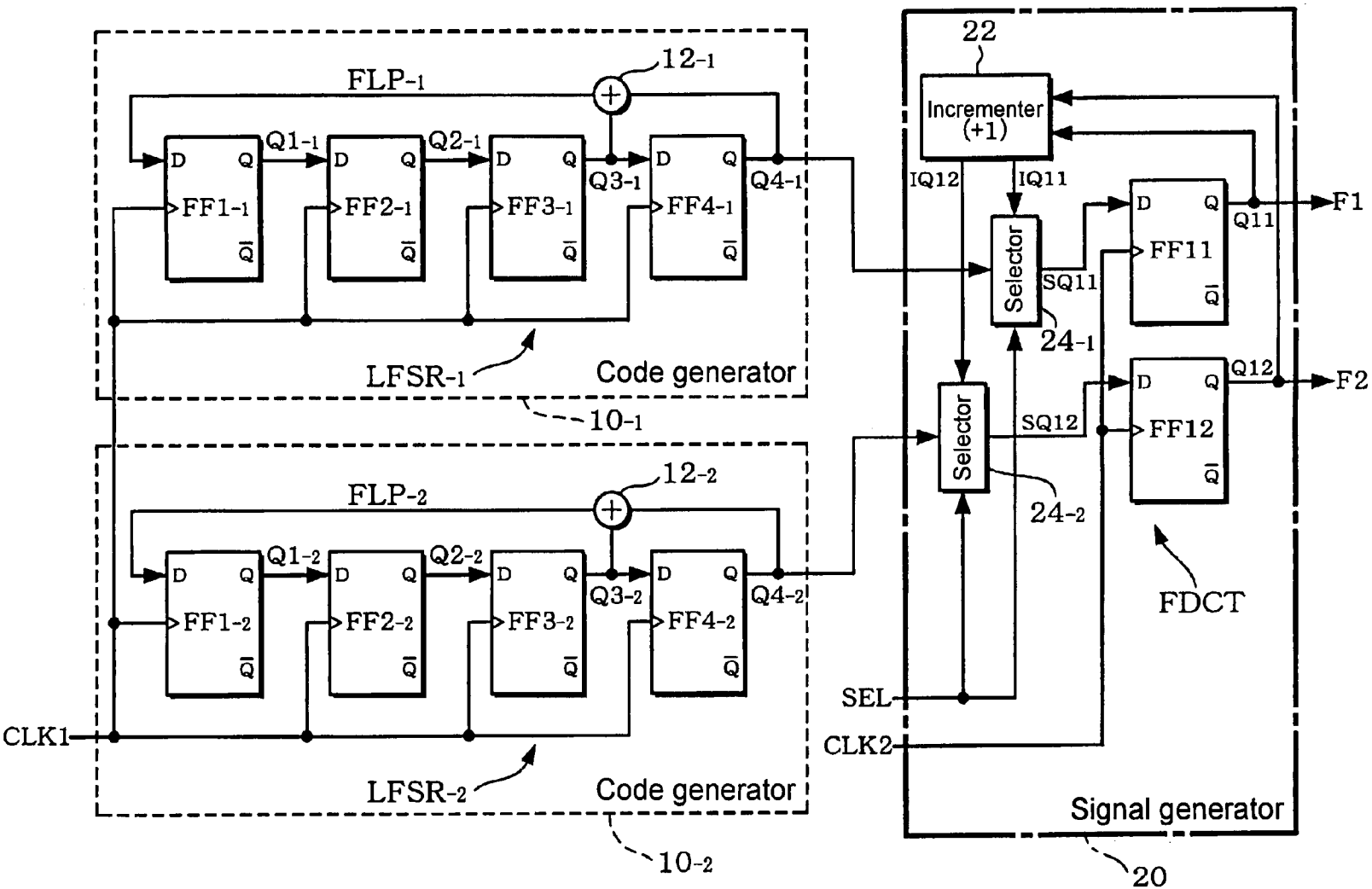
FIG. 16 is an example of the configuration using a plurality of code generators.

In FIG. 16, for example, two code generators $\mathbf{10}_{-1}$ and $\mathbf{10}_{-2}$ are provided. The code generator $\mathbf{10}_{-1}$ (the first code generator) has a linear feedback shift register $LFSR_{-1}$ composed of flip-flops $FF_{-1}$ to $FF\mathbf{4}_{-1}$, an adder $\mathbf{12}_{-1}$, and a feedback loop $FLP_{-1}$, while the code generator $\mathbf{10}_{-2}$ (the second code generator) has a linear feedback shift register $LFSR_{-2}$ composed of flip-flops $FF1_{-2}$ to $FF4_{-2}$, an adder $12_{-2}$, and a feedback loop $FLP_{-2}$.

The random number sequence from a tap $Q4_{-1}$ of the $LFSR_{-1}$ and the random number sequence from a tap $Q4_{-2}$ of the $LFSR_{-2}$ are input to the signal generator 20. The random number sequences from other taps ($Q1_{-1}$ to $Q3_{-1}$, $Q1_{-2}$ to $Q3_{-2}$) of $LFSR_{-1}$ and $LFSR_{-2}$ may be input to the signal generator 20.

A selector $24_{-1}$ selects the tap $Q4_{-1}$ of the $LFSR_{-1}$ when setting the load value for the field counter FDCT, and selects the output signal IQ11 of the incrementer 22 when incrementing the count value CT. On the other hand, a selector $24_{-2}$ selects the tap $Q4_{-2}$ of the $LFSR_{-2}$ when setting the load value for the field counter FDCT, and selects the output signal IQ12 of the incrementer 22 when incrementing the count value CT. The output signals SQ11 and SQ12 from the selectors $24_{-1}$ and $24_{-2}$ are input to the data terminals of the flip-flops FF11 and FF12, respectively. Then the output signal Q11 of FF11 and the inverted output signal Q12B of FF12 are output as the field selection signals F1 and F2. Thus, the field selection signals F1 and F2 that vary the field selection randomly are generated.

FIG. 16 shows a configuration in which two code generators are provided. However, a configuration in which three or more code generators are provided may be used. In cases where a plurality of code generators are provided as in FIG. 16, random number sequences from two or more taps of an LFSR of a code generator may be input to the signal generator 20.

The present invention is not limited to the preferred embodiment, and various modifications can be made within the scope of the spirit of the present invention.

For example, terms (liquid crystal display device, liquid crystal element, four times, four flip-flops, two-bit, two, flip-flop, or the like), which are used as terms of broader meaning (electro-optic device, display element, N times, N, K-bit, K, retaining means, or the like) in the specification, can also be replaced with terms of broader meaning at other descriptions in the specification.

Furthermore, configurations of the electro-optic device, the display driver, the data driver, the scan driver, the code generator and the signal generator are not limited to those described in the preferred embodiment, which are explained just as examples, and various modifications can be made within the scope of the present invention. Additionally, as for the generation method of random number sequences, various modifications that are equivalent to the above-described method in the preferred embodiment can be made.

Moreover, the MLS drive method is not limited to those described in FIG. 4(A), (B) and FIG. 5, and various modifications can be made. For example, a MLS drive method that utilizes virtual data may be employed. The present invention can also be applied to drive methods based on a similar concept of the MLS drive method.

The preferred embodiment of the present invention describes the case of applying a liquid crystal device using a liquid crystal as electro-optic material. However, the present invention can also be applied to a broad range of electro-optic devices using the electro-optic effects such as an electro-luminescence, a fluorescent display tube, a plasma display, an organic electro-luminescence and so forth.

What is claimed is:

1. A display driver that drives a display panel by a multi-line drive system for selecting a plurality of scan lines simultaneously, comprising:

at least one code generator, which has a linear feedback shift register, and generates pseudo random number sequences with the linear feedback shift register;

a signal generator that receives random number sequences output by K taps (K being an integer that is two or more) of the linear feedback shift register included in the at least one code generator, and generates field selection signals that randomly vary field selection sequences based on the random number sequences; and a scan driver that outputs scan signals corresponding to the fields selected by the field selection signals to scan lines, and selectively drives the scan lines.

2. The display driver according to claim 1, wherein the signal generator generates the field selection signals based on random number sequences output by K taps of the linear feedback shift register of the code generator.

3. The display driver according to claim 2, wherein the signal generator generates the field selection signals based on random number sequences output by the taps of K registers, which are adjacent each other and compose the linear feedback shift register.

4. The display driver according to claim 1, wherein the signal generator generates the field selection signals based on random number sequences output by K taps of the linear feedback shift registers of a plurality of code generators.

5. The display driver according to claim 1, wherein the load value is set to the signal generator by K bits of data with each bit configured based on random number sequences from K taps, and the signal generator includes a field counter, which increments or decrements a count value from the load value, and resets the count value to an opposite upper or lower limit value, when the count value reaches an upper limit value or a lower limit value, and generates field selection signals that correspond to the count value of the field counter.

6. The display driver according to claim 1, wherein the code generator further comprises a generator that generates random number sequences of M-sequences.

7. An electro-optic device, comprising:

the display driver according to claim 1; and a display panel that is driven by the display driver.

8. A method for driving a display panel by a multi-line drive method that selects a plurality of scan lines simultaneously, comprising:

generating pseudo random number sequences by a linear feedback shift register of at least one code generator;

generating field selection signals that randomly vary field selection sequences based on random number sequences output by K taps (K being an integer that is two or more) of the linear feedback shift register included in the at least one code generator;

outputting scan signals corresponding to the fields selected by the generated field selection signals to the scan lines; and driving the scan lines selectively.

9. The drive method according to claim 8, wherein the field selection signals are generated based on random number sequences output by K taps of a linear feedback shift register included in one code generator.

10. The drive method according to claim 8, wherein the field selection signals are generated based on random number sequences output by K taps of linear feedback shift registers included in a plurality of code generators.

11. The drive method according to claim 8, comprising:

setting K bits of data with each bit configured based on the random number sequences from K taps as the load value for a field counter;

incrementing or decrementing a count value of the field counter from the load value;

resetting the count value to the opposite upper or lower limit value, when the count value reaches an upper limit value or a lower limit value; and generating field selection signals that correspond to the count value of the field counter.

* * * * *